US006295778B1

(12) United States Patent
Burt

(10) Patent No.: US 6,295,778 B1
(45) Date of Patent: Oct. 2, 2001

(54) MODULAR BUILDING STRUCTURES COMPRISED OF EXTRUDED COMPONENTS

(75) Inventor: Kevin T. Burt, Columbus, OH (US)

(73) Assignee: Crane Products Ltd., Columbus, OH (US)

( * ) Notice: Subject to any disclaimer, the term of this patent is extended or adjusted under 35 U.S.C. 154(b) by 0 days.

(21) Appl. No.: 09/136,530

(22) Filed: Aug. 18, 1998

(51) Int. Cl.[7] ..... E04B 2/46

(52) U.S. Cl. ..... 52/592.6; 52/233; 52/592.1; 52/588.1

(58) Field of Search ..... 52/233, 592.6, 52/592.1, 309.9, 793.1, 309.12

(56) References Cited

U.S. PATENT DOCUMENTS

| | | | | |
|---|---|---|---|---|
| 2,787,029 | * | 4/1957 | Johnson . | |
| 3,662,507 | | 5/1972 | Espeland | 52/270 |
| 3,992,839 | | 11/1976 | La Borde | 52/275 |
| 4,356,676 | * | 11/1982 | Hauptman | 52/403 |
| 4,557,091 | | 12/1985 | Auer | 52/282 |
| 4,903,447 | * | 2/1990 | McDade | 52/220.2 |
| 5,031,371 | | 7/1991 | Davister | 52/236.1 |
| 5,058,343 | | 10/1991 | Nipko | 52/233 |
| 5,163,259 | | 11/1992 | Hunsaker et al. | 52/233 |
| 5,247,773 | * | 9/1993 | Weir | 52/592 |
| 5,577,356 | * | 11/1996 | Hubbard | 52/233 |
| 5,680,735 | * | 10/1997 | Bates | 52/591.5 |
| 5,697,196 | | 12/1997 | SalahUddin | 52/379 |
| 5,706,620 | * | 1/1998 | De Zen | 52/102 |
| 5,966,896 | * | 10/1999 | Tylman | 52/793.1 |

* cited by examiner

*Primary Examiner*—Carl D. Friedman
*Assistant Examiner*—Patrick J. Chavez
(74) *Attorney, Agent, or Firm*—Standley & Gilcrest LLP

(57) ABSTRACT

A modular wall structure comprised of a plurality of horizontally-oriented wall panels which are extruded components that are connected together in a stack. A plurality of modular wall structures of the present invention may be connected by fastening panels. The fastening panels may also be extruded components. In addition, preferred embodiments of the present invention may include a foundation, a roof, and an interior wall section. The roof may be comprised of a roofing panel which is an extruded component. Similarly, the interior wall section may be comprised of a plurality of horizontally-oriented interior wall panels which are extruded components that are connected together in a stack.

14 Claims, 21 Drawing Sheets

MODULAR BUILDING STRUCTURES COMPRISED OF EXTRUDED COMPONENTS

BACKGROUND AND SUMMARY OF THE INVENTION

The present invention relates generally to modular building structures, and more particularly to, modular building structures comprised of extruded components. Modular building structures are typically fabricated in a factory and then assembled at the construction site. This offers the potential for high quality, precise building structures that require minimal on site construction. As a result, modular building techniques may be used to produce affordable building structures such as housing for new starts.

Solid wood has typically been employed for modular building structures. However, there is a scarcity of large logs that are appropriate for such modular building structures. Other disadvantages of traditional solid wood modular building structures include labor-intensive construction, cost, the inherent tendency of solid wood to warp, twist, splinter, rot, and become discolored, and the susceptibility of solid wood to air and bug infiltration.

In light of the deficiencies of traditional solid wood modular building structures, a need exists for modular building structures that do not use solid wood as a primary structural component. Another need exists for horizontally-oriented modular wall structures. A need also exists for a means to reinforce horizontally-oriented modular wall structures. Still yet another need exists for an improved means to secure modular wall structures to a concrete foundation. In addition, a need exists for an improved method of interconnecting modular wall structures.

The present invention satisfies some or all of these needs. In particular, the present invention provides modular building structures that are comprised of extruded components which are preferably durable and aesthetically-appealing. The extruded components of the present invention may be mass produced at relatively low cost. Moreover, the extruded components of the present invention may be precisely installed with great ease and speed.

A preferred embodiment of the present invention is a modular wall structure. The modular wall structure is comprised of a plurality of horizontally-oriented wall panels which are extruded components that are connected together in a stack. A plurality of modular wall structures may be connected by fastening panels. The fastening panels may also be extruded components. In addition, preferred embodiments of the present invention may include a foundation, a roof, and an interior wall section. The roof may be comprised of a roofing panel which is an extruded component. Similarly, the interior wall section may be comprised of a plurality of horizontally-oriented interior wall panels which are extruded components that are connected together in a stack.

The extruded components utilized in the present invention may be produced from any material that may be adapted to be formed into a predetermined extruded shape. Consequently, the extruded components may be comprised of thermoplastic material including, but not limited to, multi-layer films, polyethylene (HDPE), polypropylene, polyvinyl chloride (PVC), low density polyethylene (LDPE), CPVC ABS, ethyl-vinyl acetate, other similar polyethylene copolymers, other similar thermoplastic materials, other sufficiently rigid thermoplastic materials, or formulations that incorporate any of the aforementioned thermoplastic materials. Accordingly, the extruded components may also be produced from cellulosic/polymer composites.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 1:
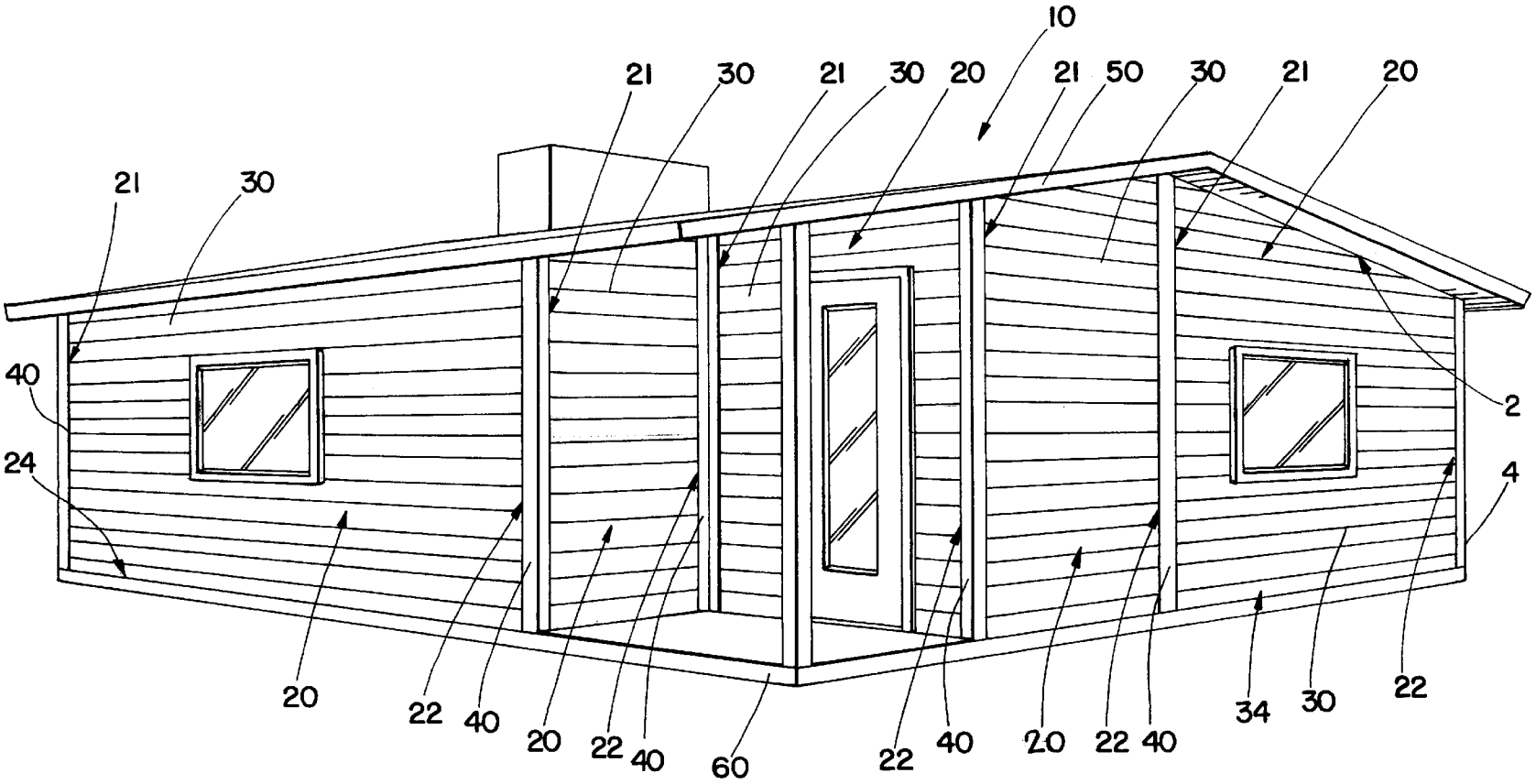
FIG. 1 is a perspective view of the present invention embodied as a modular home.
Figure 2:
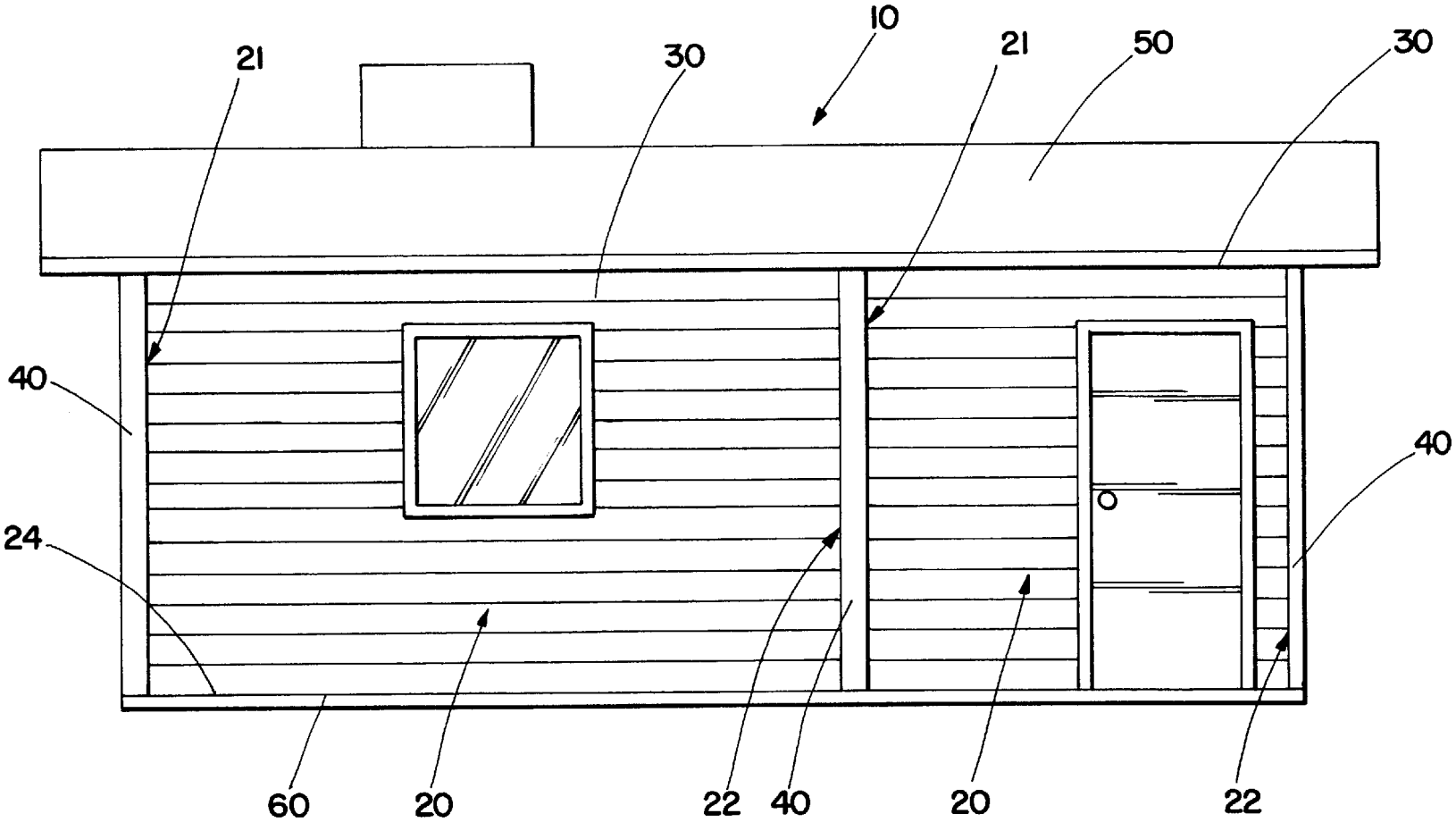
FIG. 2 is a front elevational view of the modular home shown in FIG. 1.

The present invention is directed to modular building structures comprised of extruded components. By using extruded components, the present invention provides modular building structures which may be constructed with great ease and speed. Moreover, the extruded components are preferably durable and aesthetically-appealing, and they may be mass produced at relatively low cost.

FIGS. 1 through 5 are perspective views of a preferred embodiment of a modular building structure 10 of the present invention. As shown in FIGS. 1 through 5, the modular building structure 10 comprises a plurality of exterior wall sections 20 and a plurality of fastening panels 40. At least one exterior wall section 20 is comprised of a plurality of exterior wall panels 30 which are extruded components that are connected together in a stack. In addition, each fastening panel 40 preferably connects one of the plurality of exterior wall sections 20 to another of the plurality of exterior wall sections 20.

Each exterior wall panel 30 may have at least one receptacle and/or at least one protrusion. In addition, at least one hollow preferably extends through each exterior wall panel 30. A protrusion of one exterior wall panel 30 is preferably adapted to fit into a receptacle of an adjacent exterior wall panel 30. Consequently, the exterior wall panels 30 may be connected together in a stack by inserting a protrusion of one exterior wall panel 30 into a receptacle of an adjacent exterior wall panel 30. In addition, it is preferred that an adhesive or other similar means is used to further secure exterior wall panels 30 together in a stack.

Figure 6:
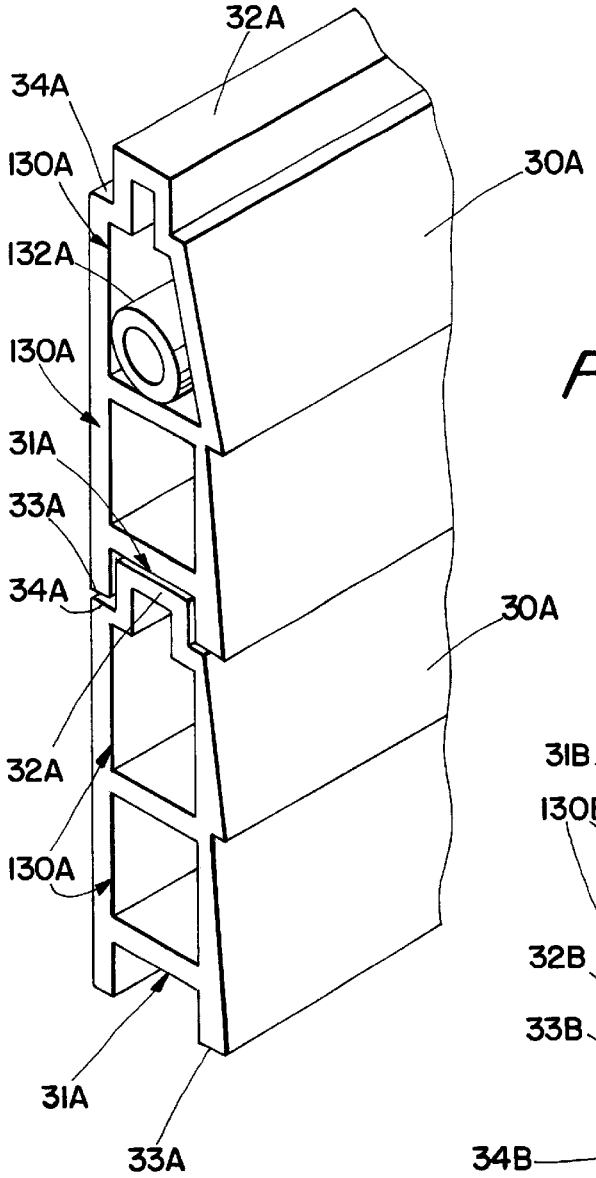
FIG. 6 is a perspective view of a first embodiment of horizontally-oriented exterior wall panels of the present invention that are connected together in a stack.

As indicated by FIGS. 1 through 5, the plurality of exterior wall panels 30 may be horizontally-oriented. FIGS. 6 through 9 illustrate various embodiments of horizontally-oriented exterior wall panels 30. In particular, FIG. 6 illustrates a preferred embodiment of horizontally-oriented exterior wall panels 30A that may be stacked in the above-described manner. As shown in FIG. 6, each exterior wall panel 30A may have a bottom side 33A and a top side 34A. Each bottom side 33A may have at least one receptacle 31A, and each top side 34A may have at least one protrusion 32A which is adapted to mate with the at least one receptacle 31A of an adjacent exterior wall panel 30A. Consequently, the exterior wall panels 30A may be connected together in a stack by inserting the at least one protrusion 32A of one exterior wall panel 30A into the at least one receptacle 31A of an adjacent exterior wall panel 30A. In this type of embodiment, the at least one receptacle 31A may be a channel.

FIG. 6 also shows a preferred method for reinforcing various embodiments of horizontally-oriented exterior wall panels 30. As shown in the example of FIG. 6, reinforcement material 132A may be inserted in a hollow 130A of an exterior wall panel 30A. It is preferred that reinforcement material extends throughout the length of a hollow for maximum reinforcement. It is also preferred that the reinforcement material connects the horizontally-oriented exterior wall panel 30 to at least one fastening panel 40 for additional support. The reinforcement material may be any material that further supports, reinforces, strengthens, and/or stabilizes an exterior wall section 20 and/or an exterior wall panel 30. For example, the reinforcement material may be a tube, pipe, rod, cylinder, sand, cement, or any other similar material or device.

Figure 7:
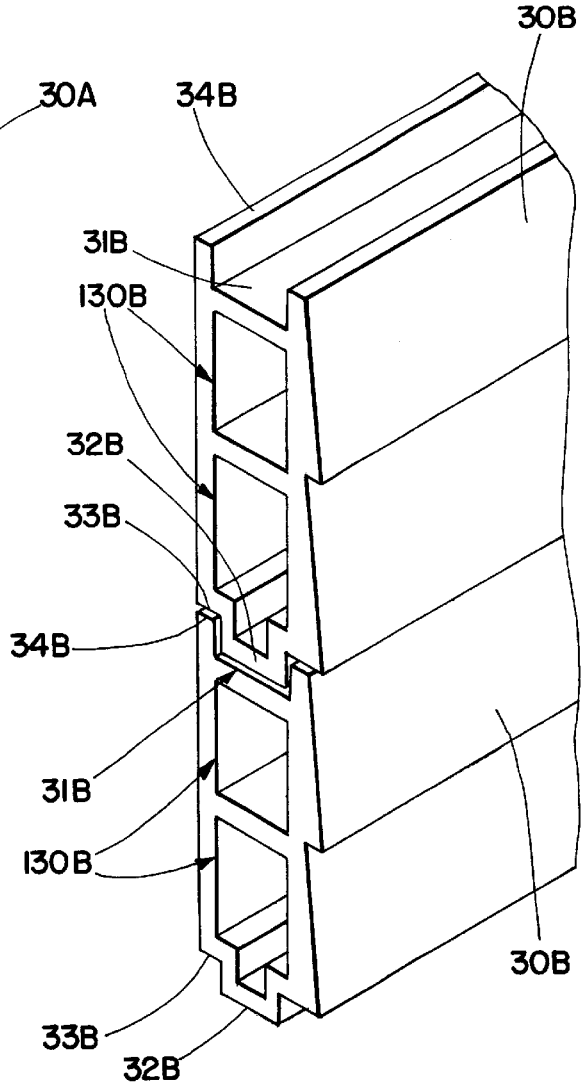
FIG. 7 is a perspective view of a second embodiment of horizontally-oriented exterior wall panels of the present invention that are connected together in a stack.

FIG. 7 illustrates another preferred embodiment of horizontally-oriented exterior wall panels 30B that may be stacked one on top of the other. As shown in FIG. 7, each exterior wall panel 30B may have a bottom side 33B, a top side 34B, and at least one hollow 130B. Each top side 34B may have at least one receptacle 31B, and each bottom side 33B may have at least one protrusion 32B which is adapted to mate with the at least one receptacle 31B of an adjacent exterior wall panel 30B. As a result, the exterior wall panels 30B may be connected together in a stack by inserting the at least one protrusion 32B of one exterior wall panel 30B into the at least one receptacle 31B of an adjacent exterior wall panel 30B. As FIG. 7 illustrates, the at least one receptacle 31B may be a channel.

Figure 8:
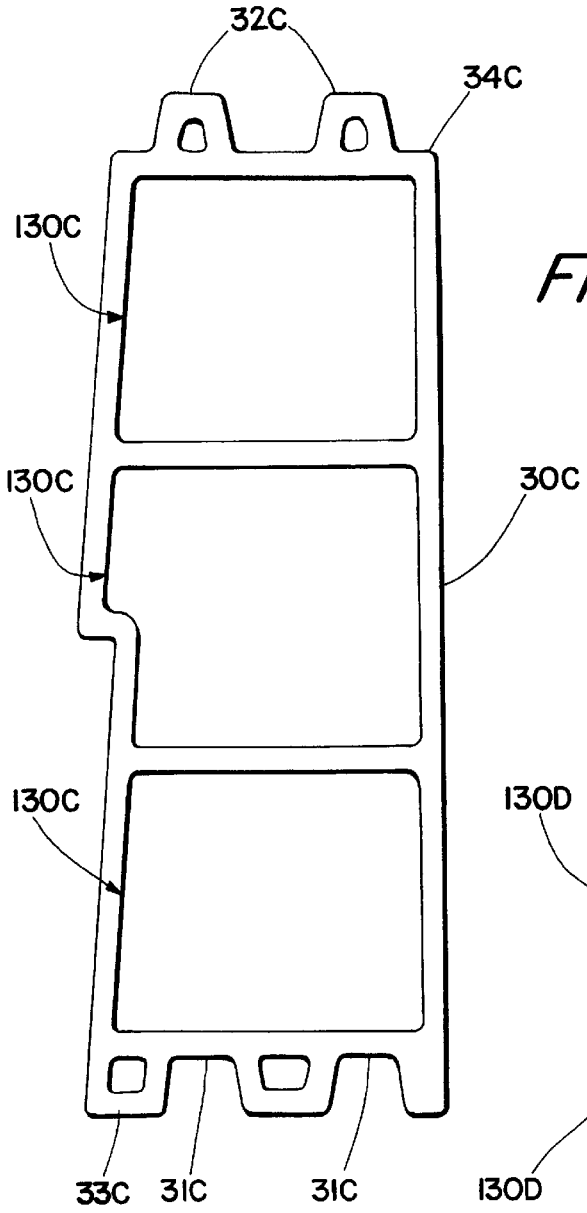
FIG. 8 is a cross sectional view of a third embodiment of a horizonitally-oriented exterior wall panel of the present invention.

FIG. 8 illustrates yet another preferred embodiment of a horizontally-oriented exterior wall panel 30C that may be stacked. As shown in FIG. 8, each exterior wall panel 30C may have a bottom side 33C, a top side 34C, and at least one hollow 130C. Each bottom side 33C may have at least one receptacle 31C, and each top side 34C may have at least one protrusion 32C which is adapted to mate with the at least one receptacle 31C of an adjacent exterior wall panel 30C. Consequently, the exterior wall panels 30C may be connected together in a stack by inserting the at least one protrusion 32C of one exterior wall panel 30C into the at least one receptacle 31C of an adjacent exterior wall panel 30C. In this type of embodiment, the at least one receptacle 31C may be a channel.

Figure 9:
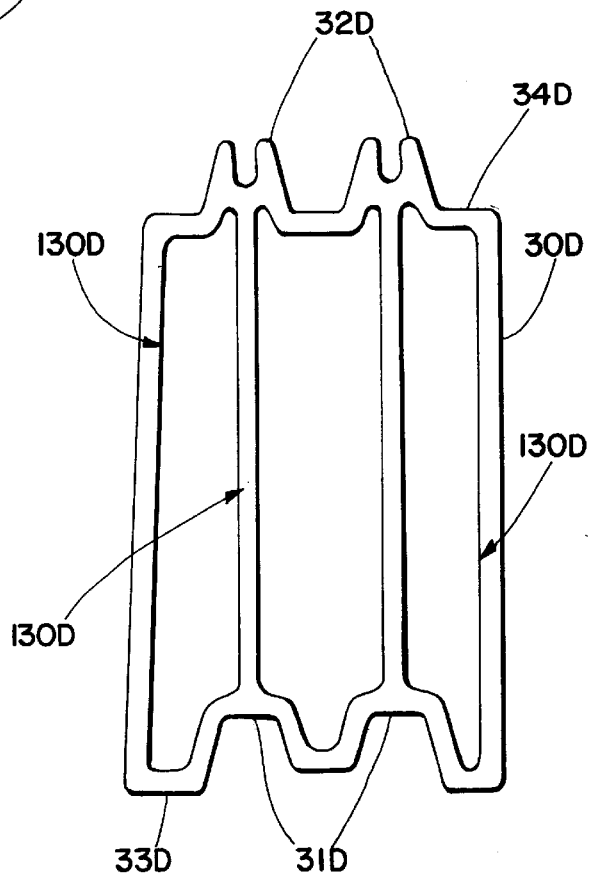
FIG. 9 is a cross sectional view of a fourth embodiment of a horizontally-oriented exterior wall panel of the present invention.

Still another embodiment of a horizontally-oriented exterior wall panel 30D is illustrated in FIG. 9. As shown in FIG. 9, each exterior wall panel 30D may have a bottom side 33D, a top side 34D, and at least one hollow 130D. Each bottom side 33D may have at least one receptacle 31D, and each top side 34D may have at least one protrusion 32D which is adapted to mate with the at least one receptacle 31D of an adjacent exterior wall panel 30D. Consequently, the exterior wall panels 30D may be connected together in a stack by inserting the at least one protrusion 32D of one exterior wall panel 30D into the at least one receptacle 31D of an adjacent exterior wall panel 30D. In this type of embodiment, the at least one receptacle 31D may be a channel.

Figure 10:
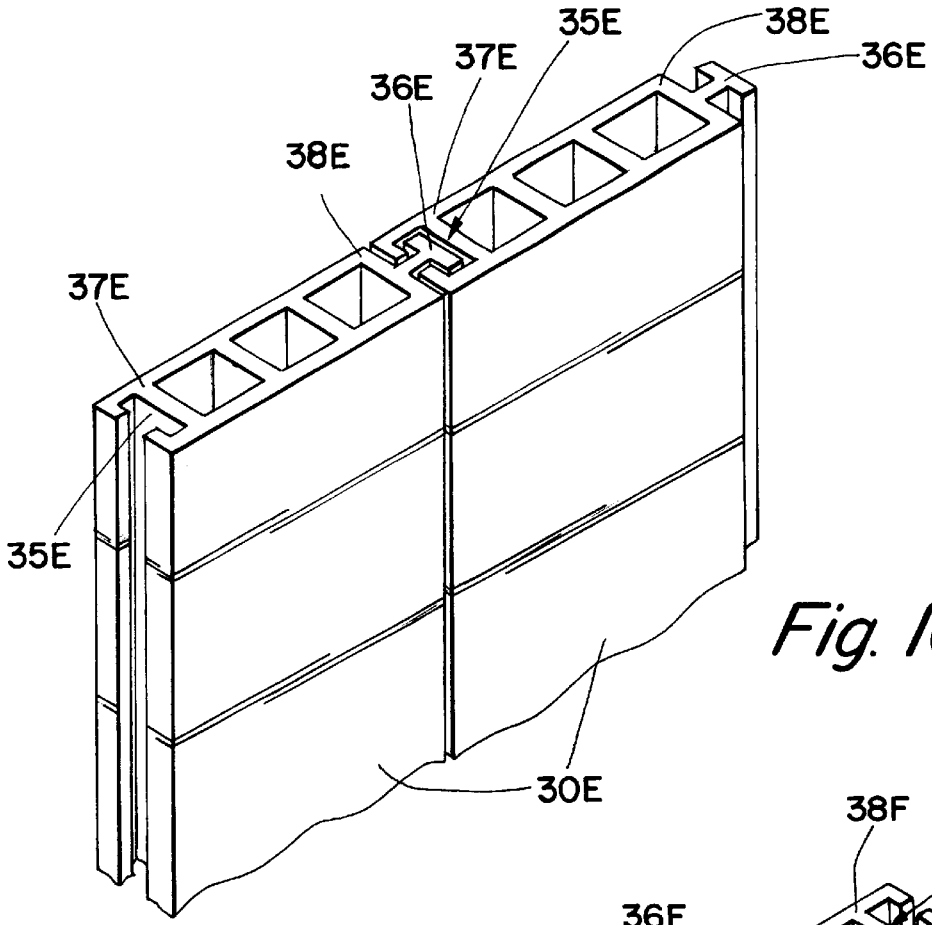
FIG. 10 is a perspective view of a first embodiment of vertically-oriented exterior wall panels of the present invention that are connected together in a stack.
Figure 11:
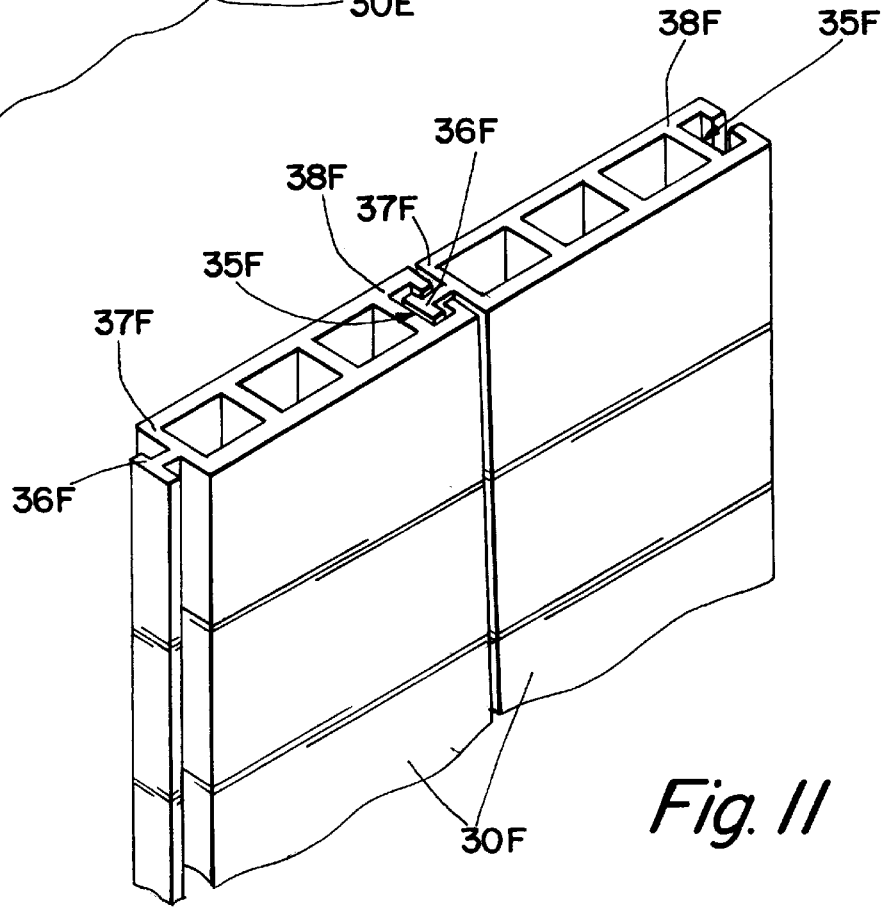
FIG. 11 is a perspective view of a second embodiment of vertically-oriented exterior wall panels of the present invention that are connected together in a stack.

In another preferred embodiment, the plurality of exterior wall panels 30 may be vertically-oriented. FIGS. 10 and 11 show various embodiments of vertically-oriented exterior wall panels 30. FIG. 10 illustrates a preferred embodiment of vertically-oriented exterior wall panels 30E that may be stacked alongside each other. FIG. 10 shows that each exterior wall panel 30E may have a left side 37E and a right side 38E. Each left side 37E may have at least one receptacle 35E, and each right side 38E may have at least one protrusion 36E which is adapted to mate with the at least one receptacle 35E of an adjacent exterior wall panel 30E. Consequently, the exterior wall panels 30E may be connected together in a stack by inserting the at least one protrusion 36E of one exterior wall panel 30E into the at least one receptacle 35E of an adjacent exterior wall panel 30E. In this type of embodiment, the at least one receptacle 35E may be a channel.

FIG. 11 illustrates another preferred embodiment of vertically-oriented exterior wall panels 30F that may be stacked alongside each other. As shown in FIG. 11, each exterior wall panel 30F may have a left side 37F and a right side 38F. Each right side 38F may have at least one receptacle 35F, and each left side 37F may have at least one protrusion 36F which is adapted to mate with the at least one receptacle 35F of an adjacent exterior wall panel 30F. The exterior wall panels 30F may then be connected together in a stack by inserting the at least one protrusion 36F of one exterior wall panel 30F into the at least one receptacle 35F of an adjacent exterior wall panel 30F. The at least one receptacle 35F may be a channel in this type of embodiment.

A preferred embodiment of the present invention interlocks adjacent exterior wall panels 30 in an exterior wall section 20. Preferred embodiments of this feature are shown in FIG. 10 and 11 with vertically-oriented exterior wall panels 30. However, this feature is not limited to vertically-oriented exterior wall panels 30. Horizontally-oriented exterior wall panels 30 may also be interlocked in the same or similar manner.

Figure 29:
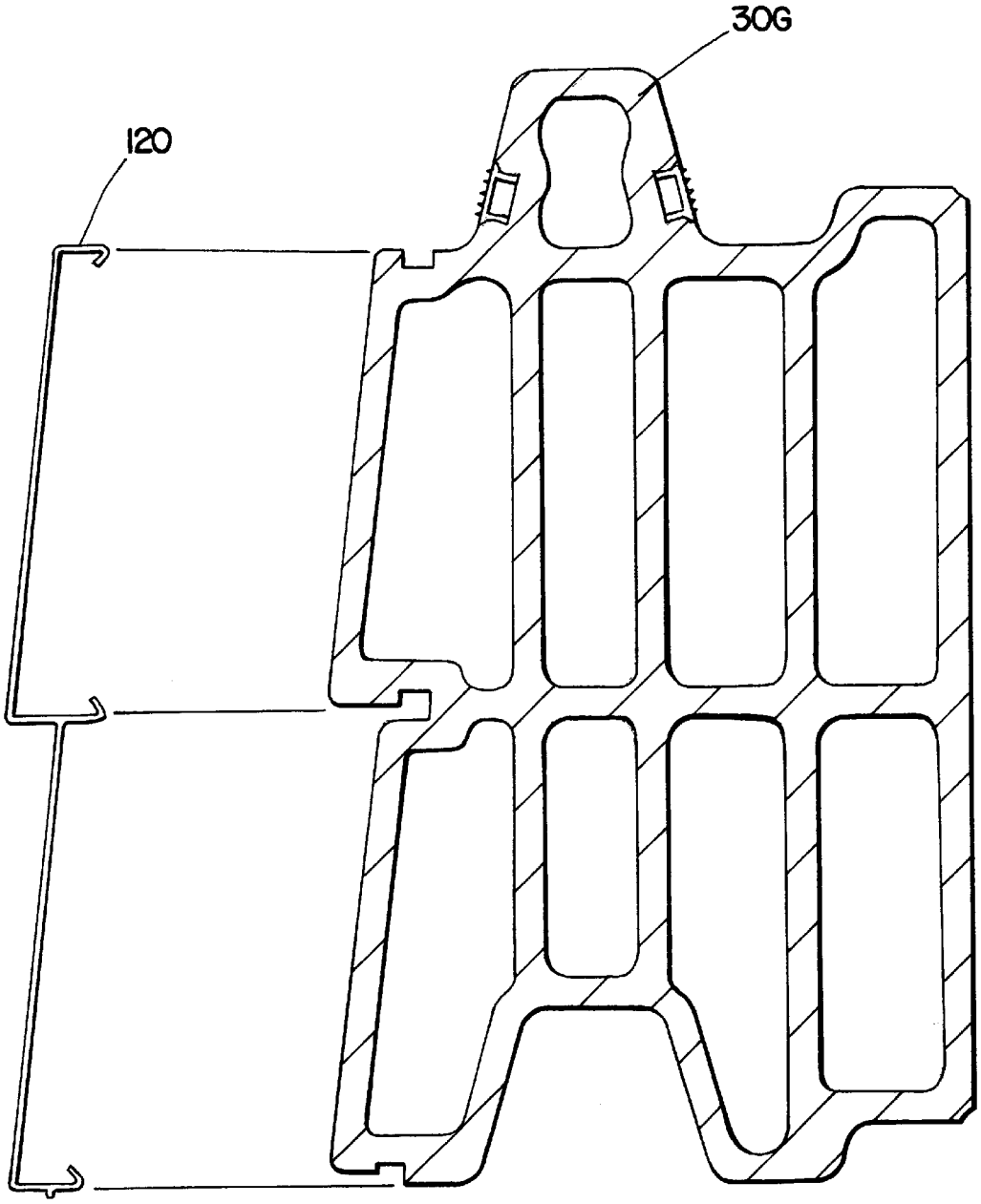
FIG. 29 is a cross sectional view of a preferred embodiment of an exterior wall panel of the present invention which is adapted to be a sided exterior wall baseboard.

FIG. 29 illustrates a preferred embodiment of an exterior wall panel 30G which is adapted to be a sided exterior wall baseboard. Accordingly, this embodiment is preferably adapted to be on the bottom of the stack of exterior wall panels 30. This embodiment is also preferably adapted to engage a piece of siding 120. In addition, the siding 120 is preferably adapted to be engaged by this embodiment of the exterior wall panel 30G.

A fastening panel 40 may be adapted to connect an exterior wall section 20 to another exterior wall section 20 or to an interior wall section at practically any desired angle. Referring back to FIGS. 1 through 5, an exterior wall section 20 may have a left edge 21 and a right edge 22. A fastening panel 40 may join the left edge 21 of one exterior wall section 20 to the right edge 22 of another exterior wall section 20. As a result, the left edge 21 of each exterior wall section 20 may be joined to the right edge 22 of an adjacent exterior wall section 20 by one of the plurality of fastening panels 40.

A fastening panel 40 may be an extruded component. As illustrated in FIGS. 1 through 5, a fastening panel 40 may join two of the exterior wall sections 20 together at an angle. The angle may be about 90 degrees, about 180 degrees, or practically any other desired angle.

Figure 22:
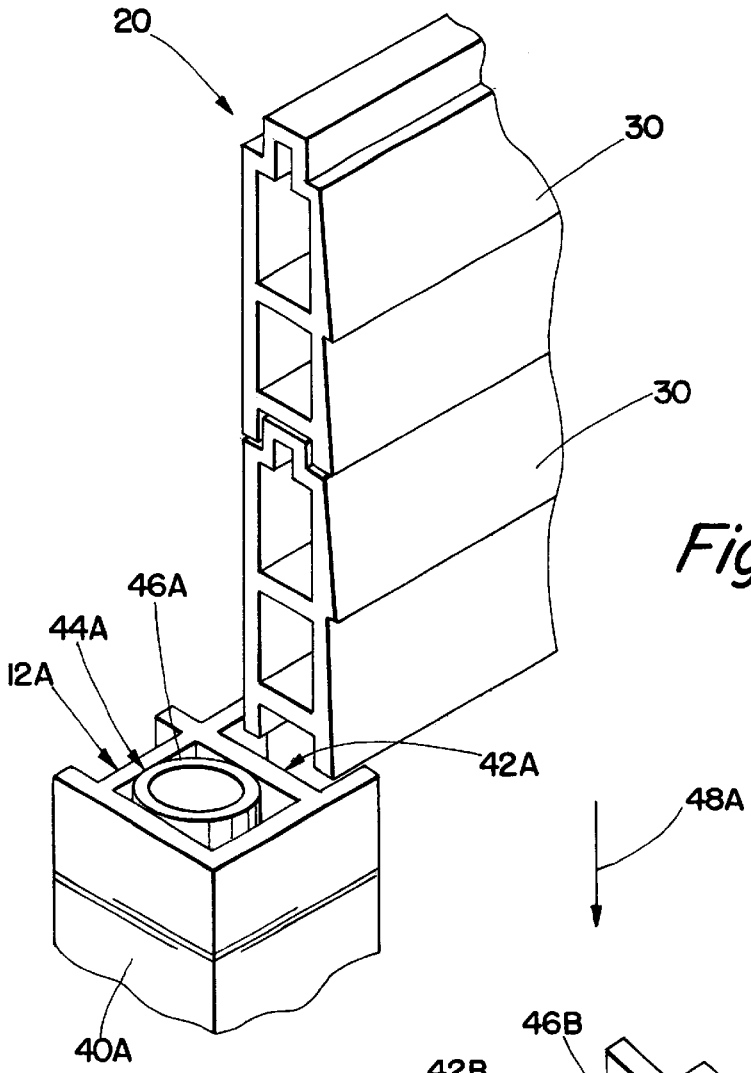
FIG. 22 is a perspective view of one embodiment of a fastening panel of the present invention that may join two exterior wall sections at an angle.

FIGS. 22 through 28 illustrate various embodiments of fastening panels 40. In particular, FIG. 22 shows a preferred embodiment of a fastening panel 40A which is adapted to join two exterior wall sections 20 together at an angle which is about 90 degrees. In this embodiment, the fastening panel 40A may have a plurality of grooves 42A and an opening 44A. A groove 42A is preferably adapted to receive an edge of an exterior wall section 20. A preferred method for inserting an edge of an exterior wall section 20 into a groove 42A is moving the exterior wall section 20 in the direction indicated by arrow 48A such that the edge slides into the groove 42A.

FIG. 22 also shows a preferred method for reinforcing various embodiments of fastening panels 40. As shown in the example of FIG. 22, reinforcement material 46A may be placed in the opening 44A. The reinforcement material may be any material that further supports, strengthens, reinforces, and/or stabilizes the modular building structure 10. Accordingly, the reinforcement material may include, but is not limited to, sand, cement, a tube, a rod, a cylinder, a pipe, and/or any other similar device or material. In addition, the reinforcement material may be set in the foundation.

Figure 23:
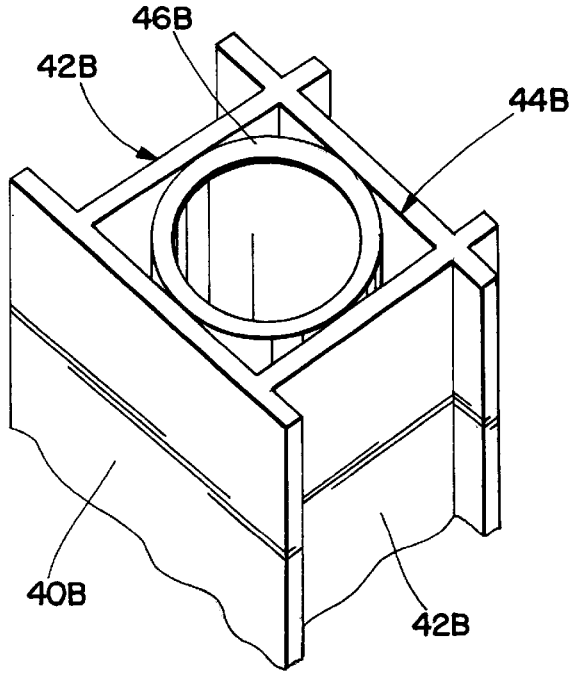
FIG. 23 is a perspective view of a second embodiment of a fastening panel of the present invention that may join two exterior wall sections together such that the two exterior wall sections are substantially coplanar and that may join an exterior wall section to an interior wall section at an angle of approximately 90 degrees.

On the other hand, FIGS. 1 through 5 also show that a fastening panel 40 may join two of the exterior wall sections 20 together such that the two exterior wall sections 20 are substantially coplanar. FIG. 23 illustrates a preferred embodiment of a fastening panel 40B which is adapted to join two exterior wall sections 20 together such that the two exterior wall sections 20 are substantially coplanar. The fastening panel 40B may also be adapted to join an exterior wall section 20 and an interior wall section 80 together at an angle which is about 90 degrees. Similar to the embodiment shown in FIG. 22, this embodiment may have a plurality of grooves 42B and an opening 44B. Reinforcement material may be placed in the opening 44B in order to further support and/or stabilize a modular building structure 10.

Figure 24:
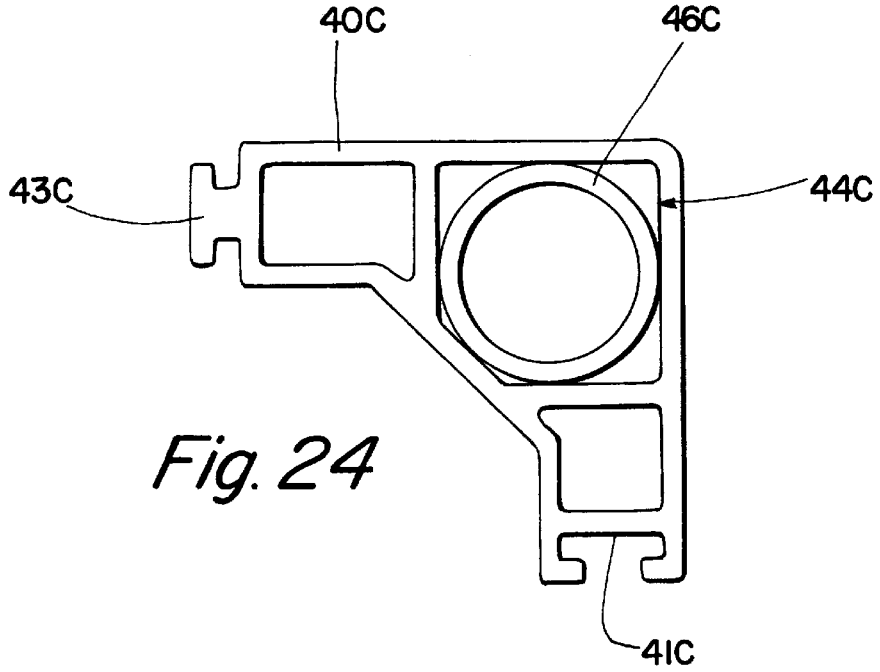
FIG. 24 is a cross sectional view of a third embodiment of a fastening panel of the present invention that may be interlocked with an exterior wall section.

In addition, a fastening panel 40 may be interlocked with one of the plurality of exterior wall sections 20. FIG. 24 shows a preferred embodiment of a fastening panel 40C which is adapted to be interlocked with an exterior wall section 20. This embodiment may include a receptacle 41C, a protrusion 43C, an opening 44C, and reinforcement material 46C such as a steel pipe. In this embodiment, the receptacle 41C is preferably adapted to interlock with an edge of an exterior wall section 20. The protrusion 43C is also preferably adapted to interlock with an edge of an exterior wall section 20.

Figure 25:
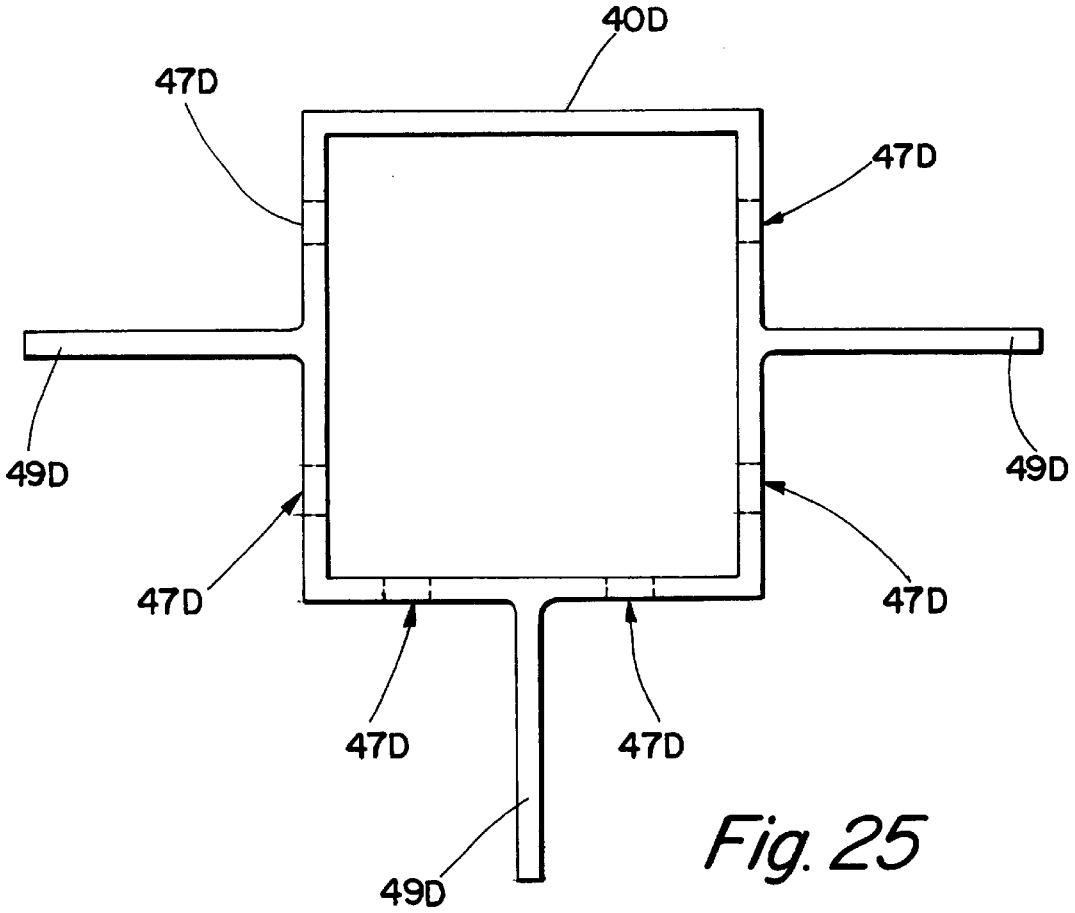
FIG. 25 is a cross sectional view of a fourth embodiment of a fastening panel of the present invention.
Figure 26:
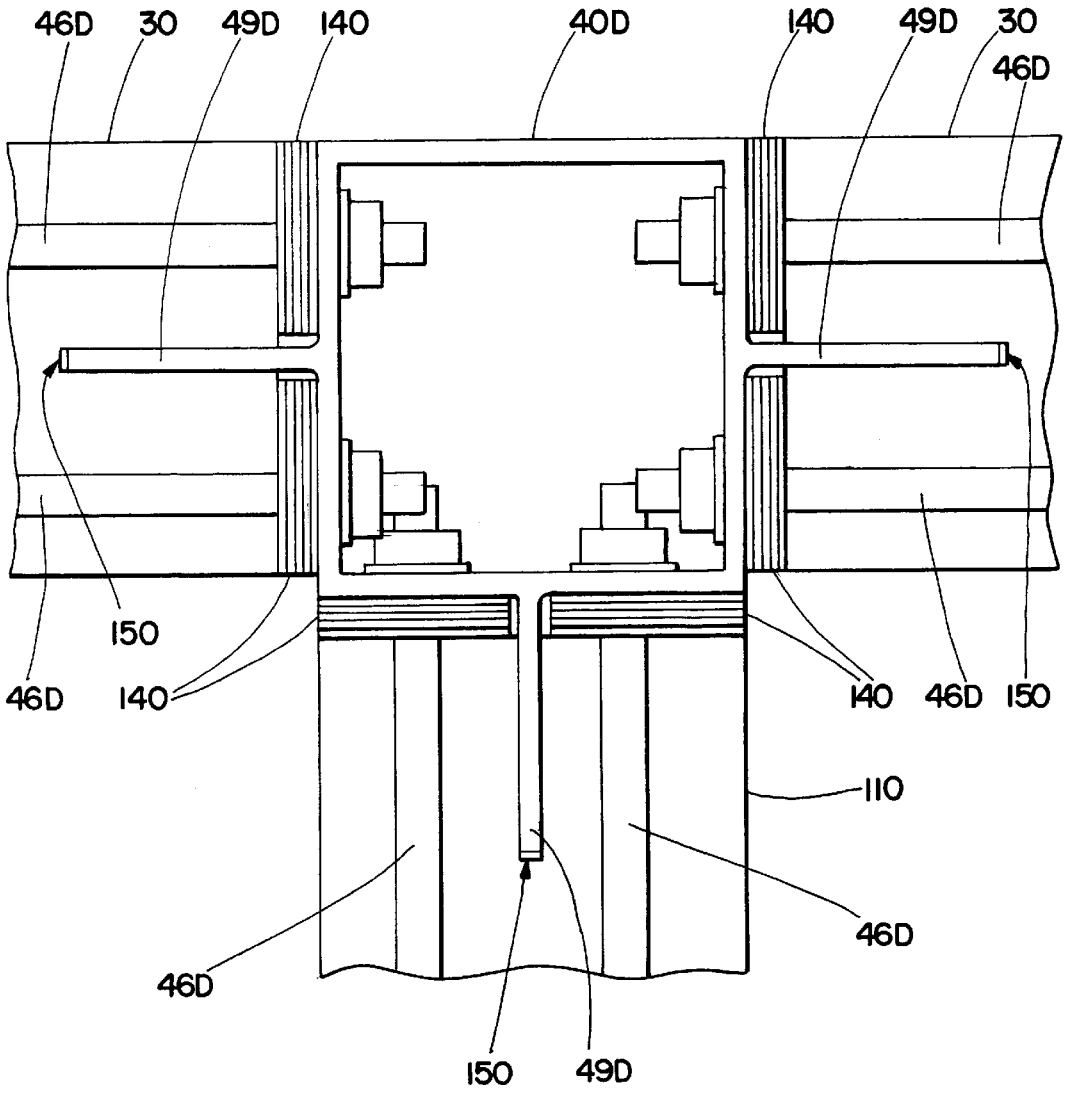
FIG. 26 is a cross sectional view of the fastening panel shown in FIG. 25 connecting wall sections of the present invention together.

FIGS. 25 and 26 illustrate an example of a fastening panel 40D. As shown in FIG. 26, the fastening panel 40D is adapted to join two exterior wall sections 20 together such that the two exterior wall sections 20 are substantially coplanar. The fastening panel 40D may also be adapted to join an exterior wall section 20 and an interior wall section 80 together at an angle which is about 90 degrees.

The fastening panel 40D is comprised of at least one penetrating member 49D. A penetrating member 49D preferably limits lateral movement of a wall section in relation to the fastening panel. As shown in FIG. 26, a fastening panel 40D preferably has at least one penetrating member 49D connected to each surface that abuts, connects, and/or is adjacent to a wall section. A penetrating member 49D may extend into a notch 150 in an edge of a horizontally-oriented or a vertically-oriented exterior or interior wall panel. In particular, it is preferred that a penetrating member 49D extends along the length of a fastening panel 40D such that the penetrating member 49D is received by notches 150 in edges of horizontally-oriented wall panels that are connected together in a stack.

FIG. 26 shows a preferred method for interconnecting and reinforcing wall sections using a fastening panel 40D. A fastening panel 40D may include at least one aperture 47D. A fastening panel 40D preferably has at least one aperture 47D in each surface that abuts, connects, and/or is adjacent to a wall section such that a reinforcing member 46D may extend through a hollow in a horizontally-oriented wall panel and connect to another fastening panel 40. For maximum reinforcement, it is preferred that the fastening panel 40D has at least one aperture 47D which corresponds to each wall panel in order to allow for reinforcement of each wall panel. In addition, it is preferred that the reinforcing member 46D has at least one threaded end in order to receive a nut or any other similar device. Accordingly, it is preferred that a reinforcing member 46D is a bolt. However, it should be recognized that a reinforcing member 46D may be any device that is adapted to extend through an aperture 47D and at least a portion of the way through a wall panel including, but not limited to, a pin, bolt, tube, rod, pipe, cylinder, or any other similar device. If necessary, access holes or openings may be provided in a surface of a fastening panel 40D in order to allow for insertion of a reinforcing member 46D or to allow access to a nut or any type of fastening device. If desired, a trim profile or any other adequate covering device may be connected to the fastening panel 40D to cover the access holes or openings when access is not needed.

FIG. 26 also shows that the respective edges of exterior wall panels 30 and interior wall panels 110 may include expansion blocks 140. An expansion block 140 is preferably adapted to expand and contract to provide a 'tight' connection between a fastening panel 40 and a wall panel. For example, an expansion block 140 may expand and contract to compensate for expansion and contraction of a wall panel and/or a fastening panel. In addition, an expansion block 140 is preferably adapted to provide insulating value and to limit air flow through the joint between a fastening panel and a wall panel. It should be recognized that an expansion block 140 may block some, all, or none of an entry to a hollow of a wall panel. If desired, access openings or breaks may be provided in an expansion block 140 to allow for insertion of a penetrating member, a reinforcing member, or practically any other device.

An expansion block 140 may be comprised of practically any material that is adapted to expand and contract. For example, it is preferred that an expansion block 140 is comprised of elastic material including, but not limited to, foamed rubber, any other similar material, or any other foamed plastic, polymer, or thermoplastic material. An expansion block 140 may be connected to an edge of the extruded portion of a wall panel by conventional means. In a preferred embodiment of the invention, an expansion block 140 is connected to an edge of the extruded portion of a wall panel by an adhesive, an epoxy, or practically any other similar material.

Figure 27:
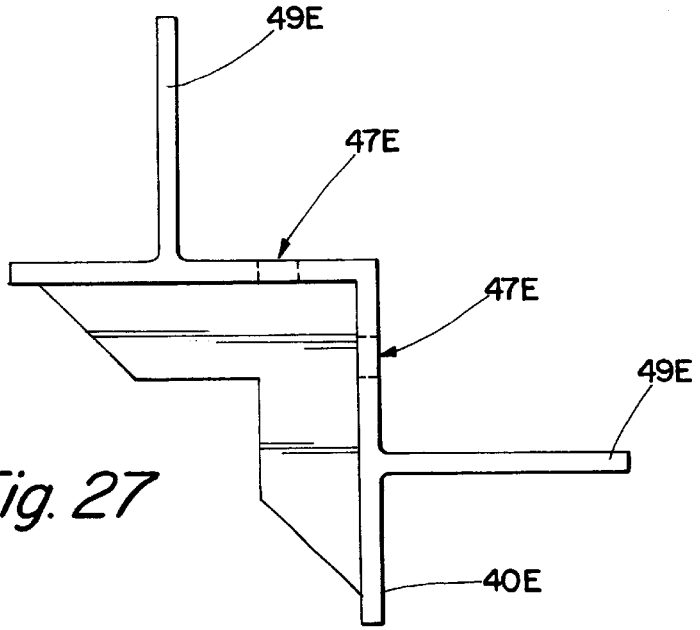
FIG. 27 is a cross sectional view of a fifth embodiment of a fastening panel of the present invention.
Figure 28:
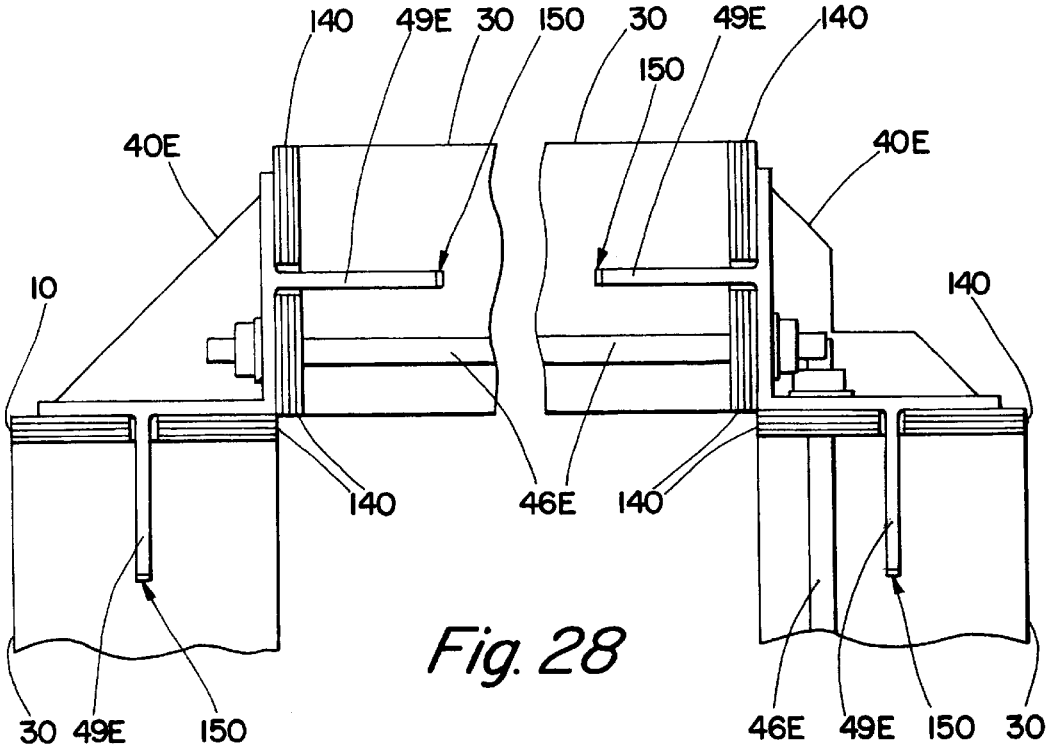
FIG. 28 is a cross sectional view of the fastening panel shown in FIG. 27 connecting wall sections of the present invention together.

FIGS. 27 and 28 show yet another embodiment of a fastening panel 40E. A fastening panel 40E may be adapted to connect two exterior wall sections 20 together at an angle of approximately 90 degrees. A fastening panel 40E is comprised of a penetrating member 49E. As shown in FIG. 28, a fastening panel 40E preferably has at least one penetrating member 49E on each surface that abuts, connects, and/or is adjacent to a wall section. A penetrating member 49E may extend into a notch 150 in an edge of a horizontally-oriented or a vertically-oriented wall panel. In particular, it is preferred that a penetrating member 49E extends along the length of a fastening panel 40E such that the penetrating member 49E is received by notches 150 in edges of horizontally-oriented wall panels that are connected together in a stack.

FIG. 28 also shows a preferred method for interconnecting and reinforcing wall sections using a fastening panel 40E. A fastening panel 40E may include at least one aperture 47E. A fastening panel 40E preferably has at least one aperture 47E in each surface that abuts, connects, and/or is adjacent to a wall section such that a reinforcing member 46E may extend through a hollow in a horizontally-oriented wall panel and connect to another fastening panel 40. For maximum reinforcement, it is preferred that the fastening panel 40E has at least one aperture 47E which corresponds to each wall panel in order to allow for reinforcement of each wall panel. In addition, it is preferred that the reinforcing member 46E has at least one threaded end in order to receive a nut or any other similar device. Accordingly, it is preferred that a reinforcing member 46E is a bolt. However, it should be recognized that a reinforcing member 46E may be any device that is adapted to extend through an aperture 47E and at least a portion of the way through a wall panel including, but not limited to, a pin, bolt, tube, rod, pipe, cylinder, or any other similar device. If necessary, access holes or openings may be provided in a surface of a fastening panel 40E in order to allow for insertion of a reinforcing member 46E or to allow access to a nut or any type of fastening device. If desired, a trim profile or any other adequate covering device may be connected to the fastening panel 40E to cover the access holes or openings when access is not needed.

Although not shown in the drawings, it should be recognized that fastening panels 40A, 40B may both have at least one aperture and/or at least one penetrating member substantially as described above with regard to fastening panels 40D, 40E. Those skilled in the art should also recognize that a reinforcing member may be used in conjunction with fastening panels 40A, 40B substantially as described above with regard to fastening panels 40D, 40E. Finally, those skilled in the art should recognize that fastening panels 40A, 40B may both be provided with access holes or openings substantially as described above with regard to fastening panels 40D, 40E.

Figure 3:
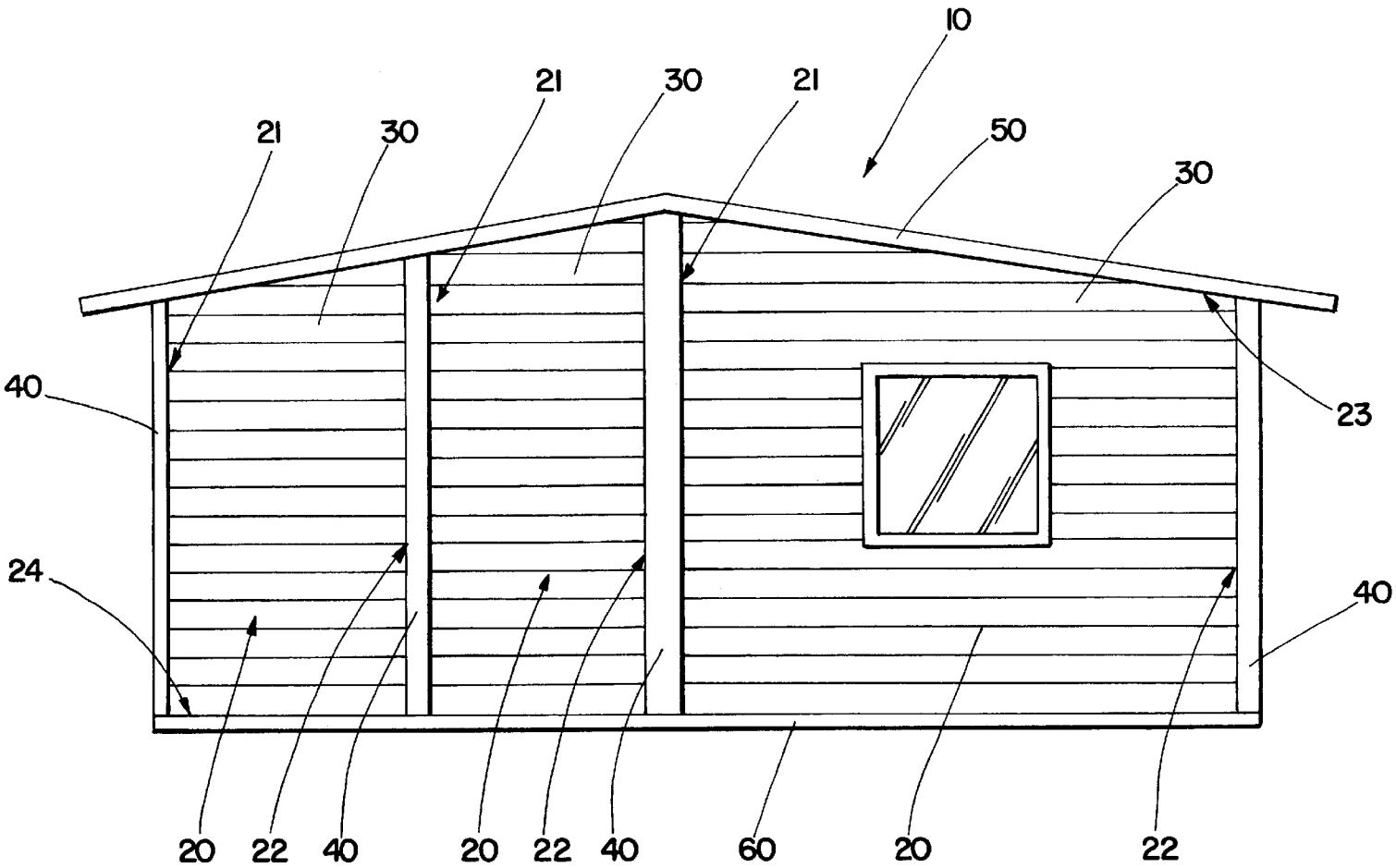
FIG. 3 is a right side elevational view of the modular home shown in FIG. 1.
Figure 4:
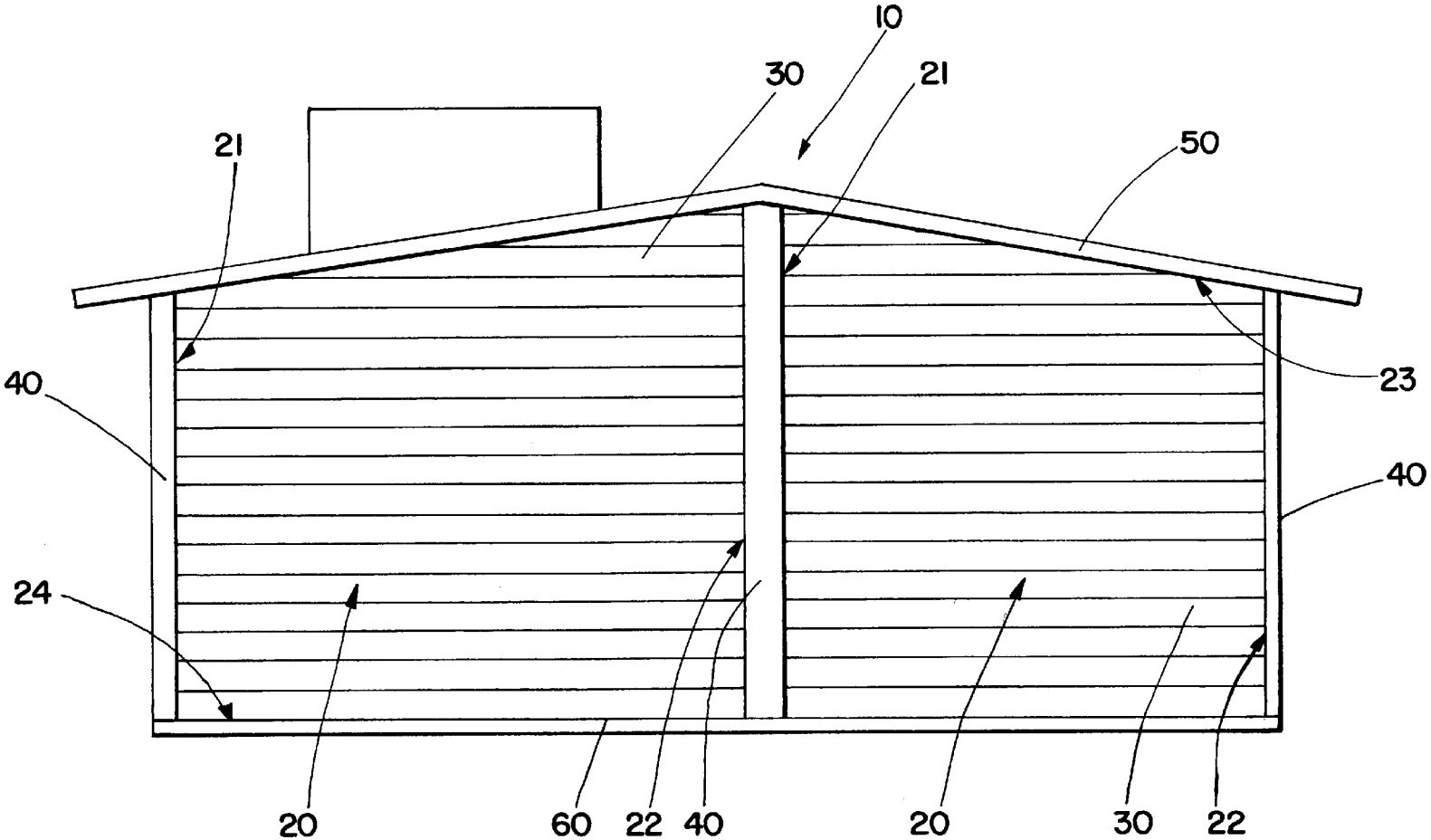
FIG. 4 is a left side elevational view of the modular home shown in FIG. 1.
Figure 5:
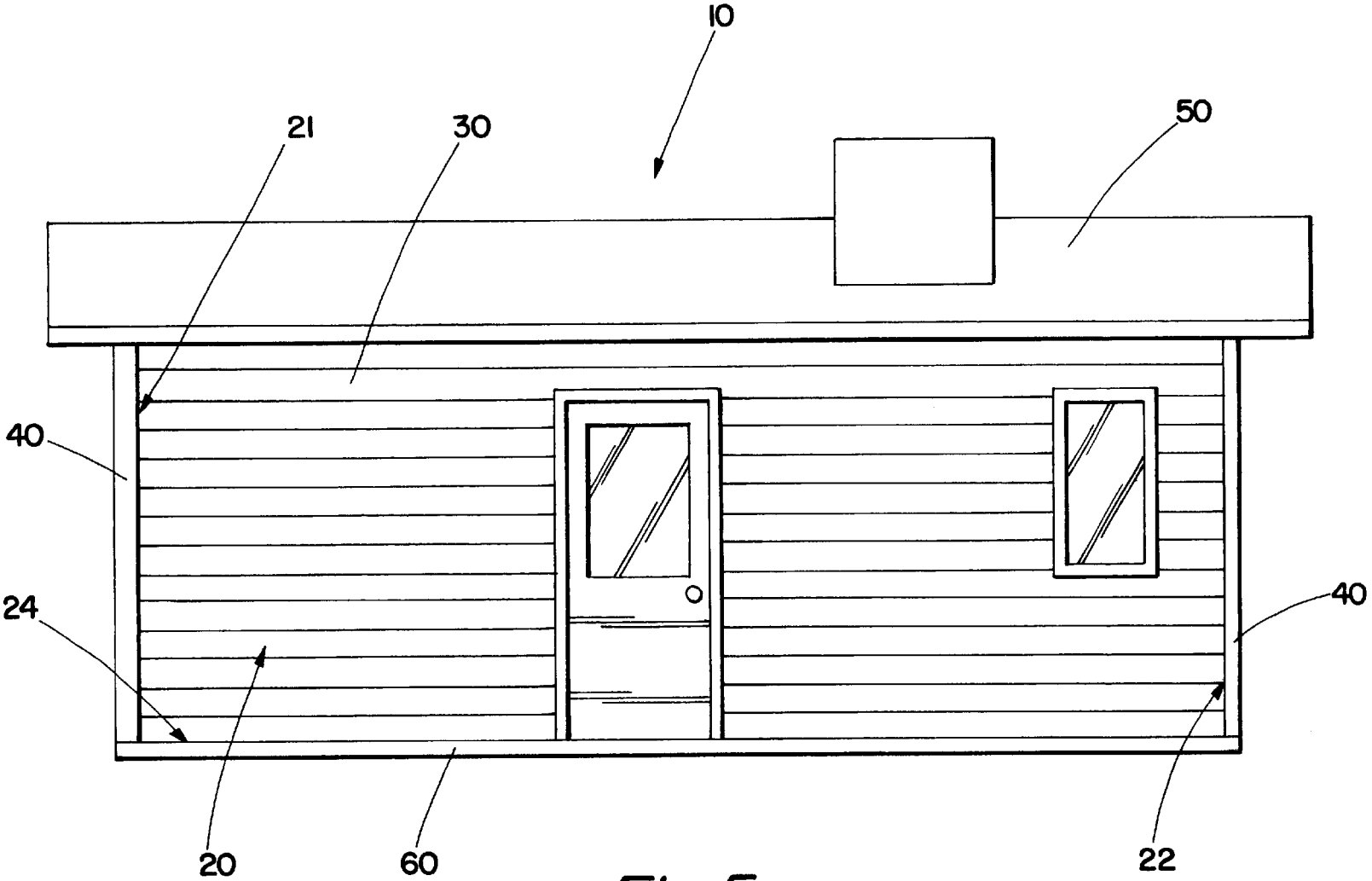
FIG. 5 is a rear elevational view of the modular home shown in FIG. 1.
Figure 12:
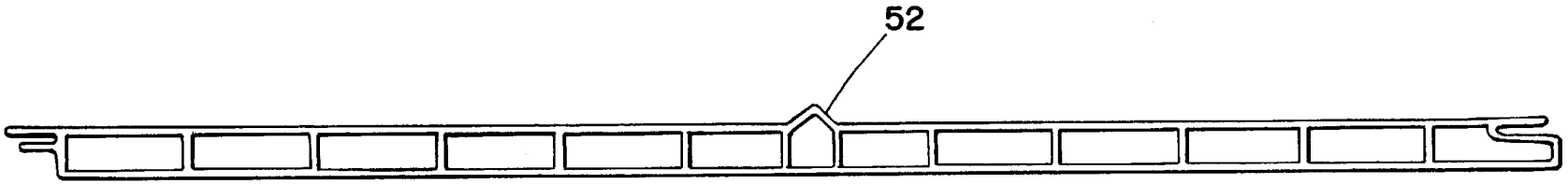
FIG. 12 is a side elevational view of a preferred embodiment of a roofing panel of the present invention.

Another preferred embodiment of a modular building structure 10 includes a roof 50 which is preferably adapted to cover the interior of a modular building structure 10. In one embodiment, the top edges of the exterior wall sections 20 may define at least a portion of a roof support 23. The roof support 23 may also be comprised of additional support and/or connecting members. As indicated by FIGS. 1, 3, and 4, the roof support 23 and the roof 50 are preferably adapted such that the roof 50 may be connected to the roof support 23. The roof 50 may be comprised of a roofing panel 52 which is a thermoplastic extruded component. FIG. 12 illustrates a preferred embodiment of a roofing panel 52. Alternatively, metal studs may comprise the roof 50.

Figure 13:
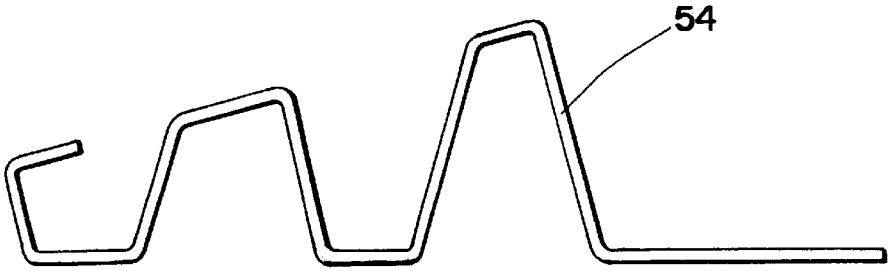
FIG. 13 is a cross sectional view of a preferred embodiment of a roof connector of the present invention.

The roof support 23 preferably includes a roof connector 54 which is adapted to rest on or be engaged by the top edge of an exterior wall section 20. FIG. 13 illustrates a preferred embodiment of a roof connector 54. The roof connector 54 may be an extruded component. However, it is preferred that the roof connector 54 is comprised of roll formed sheet metal or other similar material.

Figure 14:
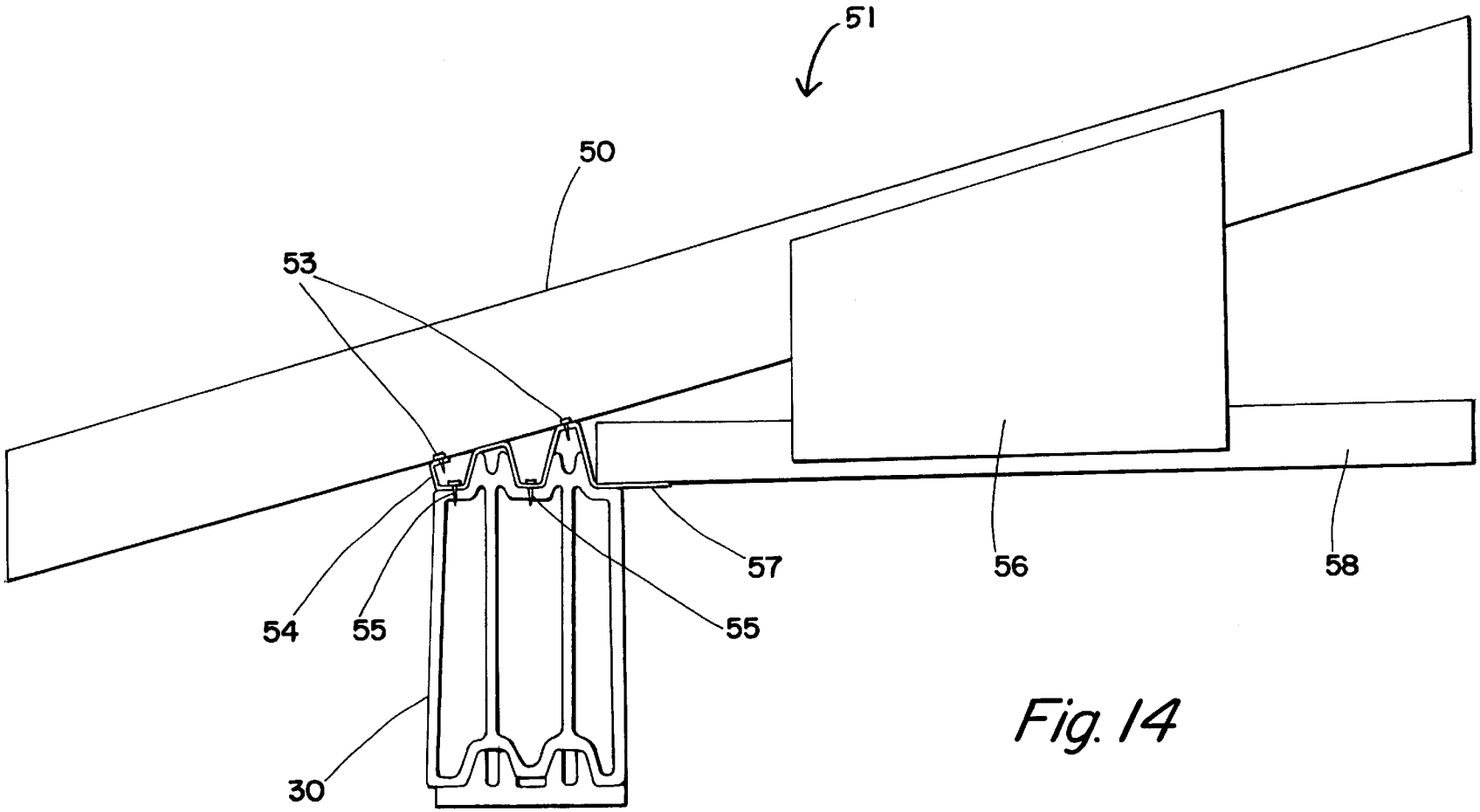
FIG. 14 is a partial cross sectional view of a preferred embodiment of a roof assembly of the present invention.

FIG. 14 is a partial cross sectional view of a preferred embodiment of a roof assembly 51 of the present invention. In this embodiment of the roof assembly 51, the roof 50 is secured to the roof connector 54 by screws 53. As shown in this example, the roof connector 54 preferably has receptacles through which the screws 53 may extend in order to secure the roof 50. Alternatively, bolts, nails, rods, adhesives, or other conventional materials or devices may be used to secure the roof 50 to the roof connector 54. The roof connector 54 may be similarly connected to the exterior wall panel 30. In this example, the roof connector 54 is secured to the exterior wall panel 30 by screws 55 which extend into and engage the exterior wall panel 30. However, it should be recognized that bolts, nails, rods, adhesives, or other conventional materials or devices may be used to secure the roof connector 54 to the exterior wall panel 30.

As shown in FIG. 14, the roof assembly 51 may be comprised of additional support mechanisms. In this example, the roof connector 54 includes a ledge 57. A support bar 58 may be adapted to rest on the ledge 57 and extend to another ledge, wall structure, or support mechanism. The support bar 58 may be secured to the ledge 57 by adhesives or other conventional means. The support bar 58 may be adapted to brace opposing wall structures. In addition, a reinforcing plate 56 may be connected by conventional means such as nails, screws, or adhesives between the roof 50 and a support bar 58 in order to reinforce the roof 50. The reinforcing plate 56 is preferably comprised of sheet metal or other similar material.

A preferred embodiment of a modular building structure 10 may include a foundation 60. As shown in FIGS. 1 through 5, the bottom edges of the exterior wall sections 20 may define an exterior base 24. The foundation 60 may be connected to at least a portion of the exterior base 24.

Figure 15:
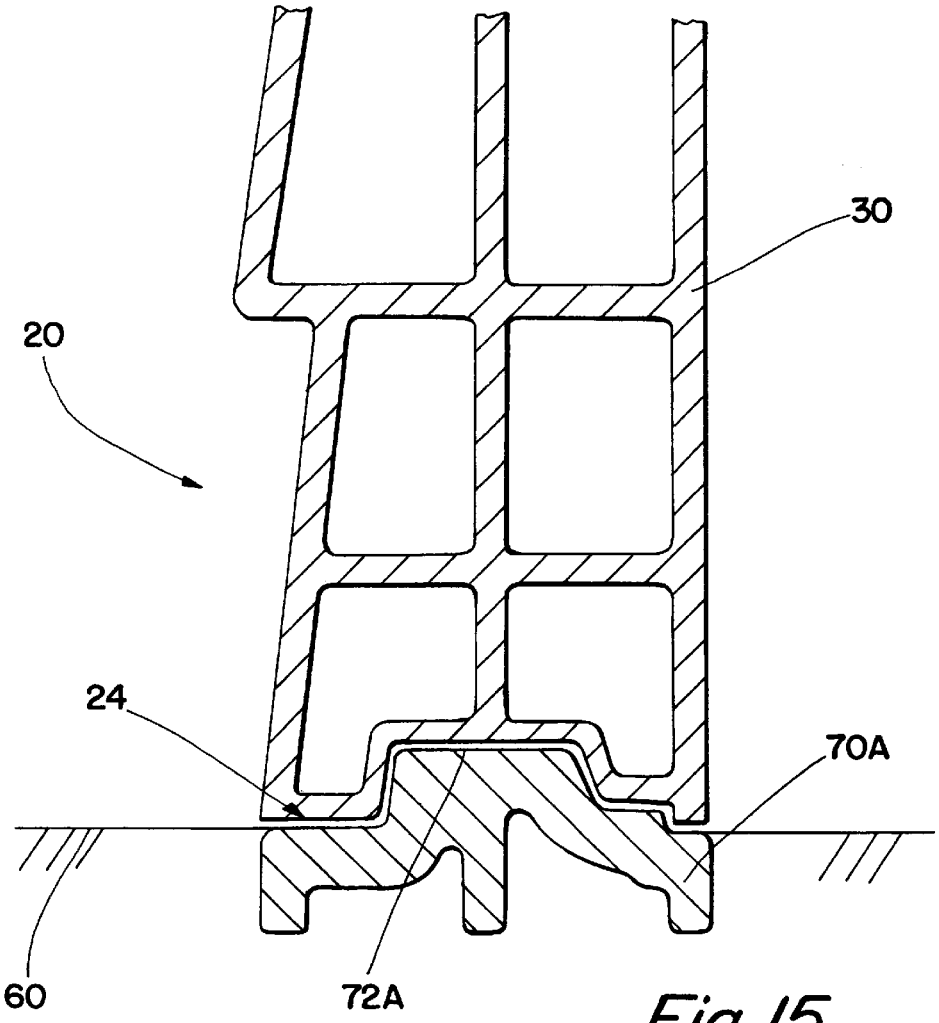
FIG. 15 is a cross sectional view of one embodiment of an exterior wall starter of the present invention which connects at least a portion of an exterior wall to a foundation.

A preferred embodiment of the modular building structure 10 may include at least one exterior wall starter which is adapted to connect at least a portion of a bottom edge of an exterior wall section 20 to a foundation 60. A preferred embodiment of an exterior wall starter 70A is shown in FIG. 15. FIG. 15 also shows a preferred method for securing an exterior wall starter 70A to a foundation 60. In this example, the exterior wall starter 70A is set in a concrete foundation 60. It should be recognized, however, that an exterior wall starter may be secured to a foundation 60 by any conventional means such as, but not limited to, adhesives, nails, bolts, screws, or other similar means.

Figure 16:
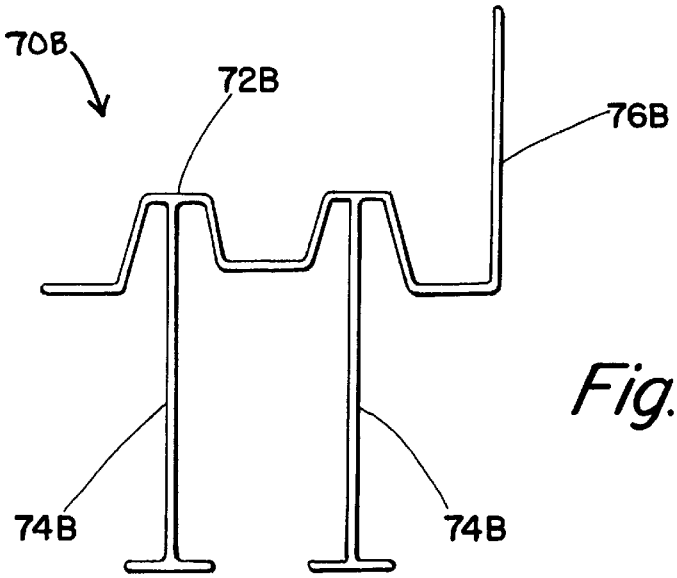
FIG. 16 is a cross sectional view of a second embodiment of an exterior wall starter of the present invention.
Figure 17:
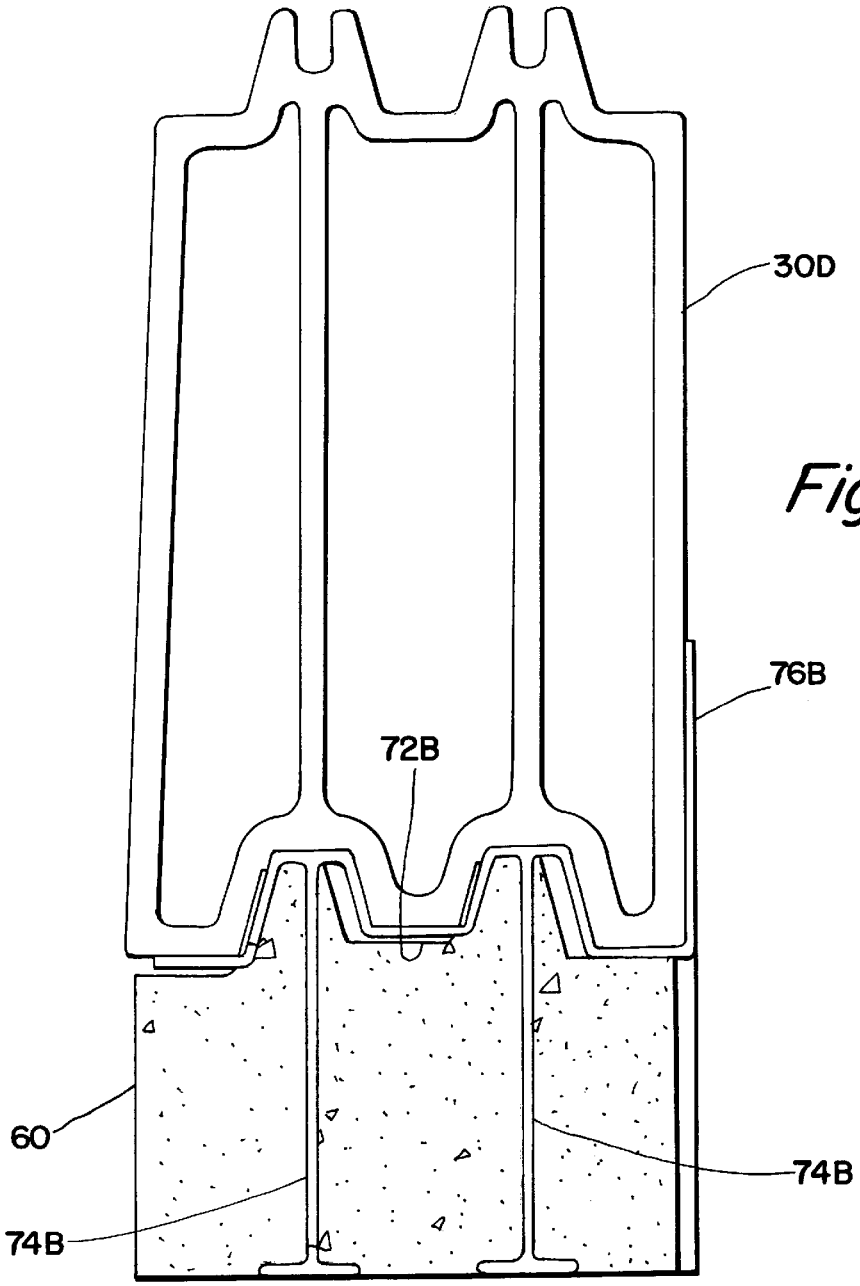
FIG. 17 is a cross sectional view of the exterior wall starter shown in FIG. 16 connecting at least a portion of an exterior wall to a foundation.

FIGS. 16 and 17 show another embodiment of an exterior wall starter 70B. An exterior wall starter 70B is comprised of a top side 72B and at least one extension 74B. An exterior wall starter 70B may also include a rim 76B. As shown in the example of FIG. 17, at least one extension 74B is connected to the top side 72B and extends into a foundation 60 which is preferably comprised of concrete. In this manner, the exterior wall starter 70B may be set in a concrete foundation 60. The rim 76B, on the other hand, is connected to the top side 72B and preferably extends up along an inner surface of an exterior wall panel 30. However, it should also be recognized that a rim may also extend up an outer surface of an exterior wall panel 30. In the example of FIG. 17, the rim 76B is preferably adapted to prevent water, dirt, and other similar moisture and debris from entering the interior of a building structure through the joint between an exterior wall starter and an exterior wall panel 30.

An exterior wall starter may be an extruded component. As shown in the examples of FIGS. 15 and 17, an exterior wall starter 70A, 70B preferably has a top side 72A, 72B which is adapted to engage and/or mate with at least a portion of the bottom edge of an exterior wall section 20. In addition, it is preferred that an adhesive or other similar means is used to further secure at least a portion of the bottom edge of an exterior wall section 20 to an exterior wall starter. In these or other conventional manners, an exterior wall starter may connect at least a portion of the exterior base 24 to a foundation 60.

In a preferred embodiment of the present invention, an exterior wall section 20 may have an inside 25. In addition, a preferred embodiment of a modular building structure 10 may have at least one interior wall section 80. An interior wall section 80 may be connected to the inside 25 of an exterior wall section 20. An interior wall section 80 may be an extruded component.

Figure 18:
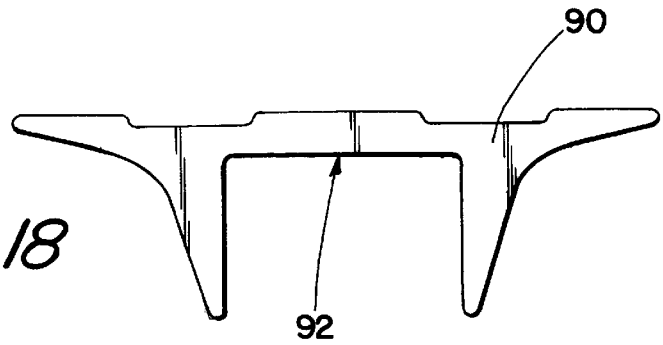
FIG. 18 is a top plan view of a preferred embodiment of an interior wall connector of the present invention.
Figure 19:
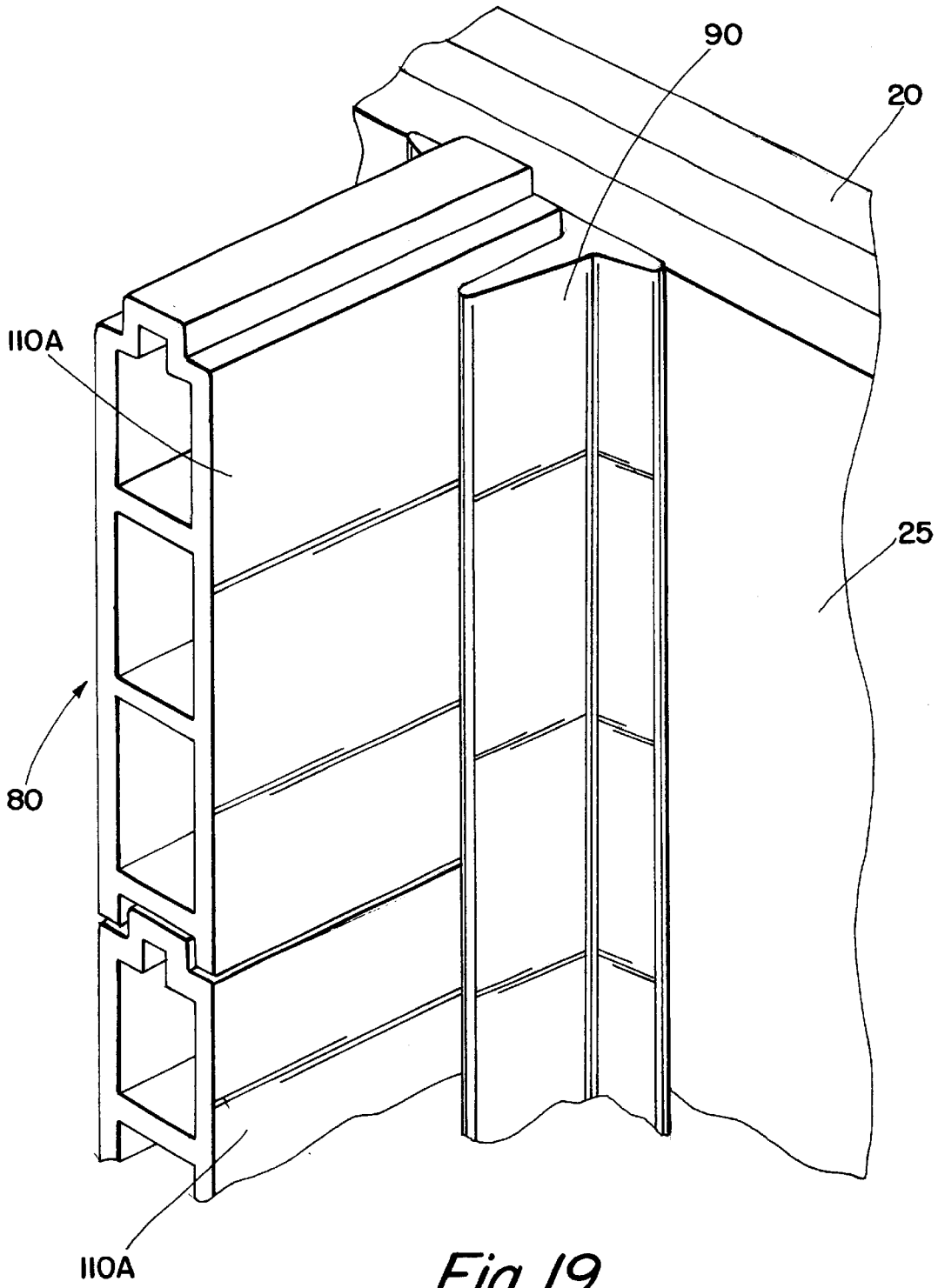
FIG. 19 is a perspective view of a preferred embodiment of an interior wall section of the present invention connected to the inside of an exterior wall section.

A preferred embodiment of a modular building structure 10 may further comprise at least one interior wall connector 90 which is adapted to connect an interior wall section 80 to the inside 25 of an exterior wall section 20. An interior wall connector 90 may be an extruded component. A preferred embodiment of an interior wall connector 90 is shown in FIG. 18. An interior wall connector 90 preferably includes a channel 92 which is adapted to receive an edge of an interior wall section 80. An interior wall connector 90 may be secured to the inside 25 by conventional means such as adhesives, screws, nails, bolts, or other similar materials or devices. FIG. 19 illustrates how a preferred embodiment of an interior wall connector 90 may connect an interior wall section 80 to the inside 25 of an exterior wall section 20.

Similar to the exterior base 24 defined by the bottom edges of the exterior wall sections 20, the bottom edge of the at least one interior wall section 80 may define an interior base 82. If there is more than one interior wall section 80, the bottom edges of the interior wall sections 80 may define an interior base 82. The interior base 82 may be connected to a foundation 60.

Figure 21:
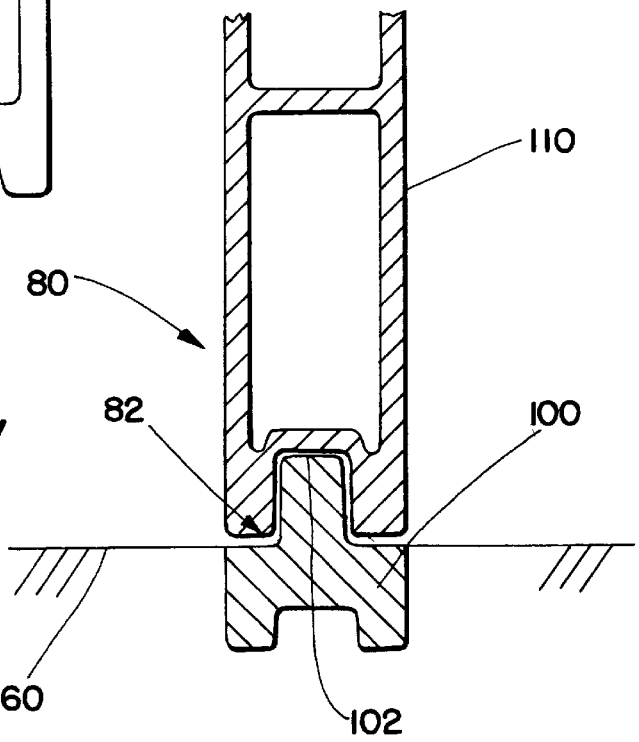
FIG. 21 is a cross sectional view of a preferred embodiment of an interior wall starter of the present invention which connects at least a portion of an interior wall to a foundation.

A preferred embodiment of the modular building structure 10 may include at least one interior wall starter 100 which is adapted to be connected to a foundation 60. An interior wall starter 100 may be an extruded component. A preferred embodiment of an interior wall starter 100 is shown in FIG. 21. The interior wall starter 100 preferably has a top side 102 which is adapted to engage and/or mate with at least a portion of the bottom edge of an interior wall section 80. In addition, it is preferred that an adhesive or other similar means is used to further secure at least a portion of the bottom edge of an interior wall section 80 to an interior wall starter 100. In this or a similar manner, an interior wall starter 100 may connect at least a portion of the interior base 82 to a foundation 60.

Figure 20:
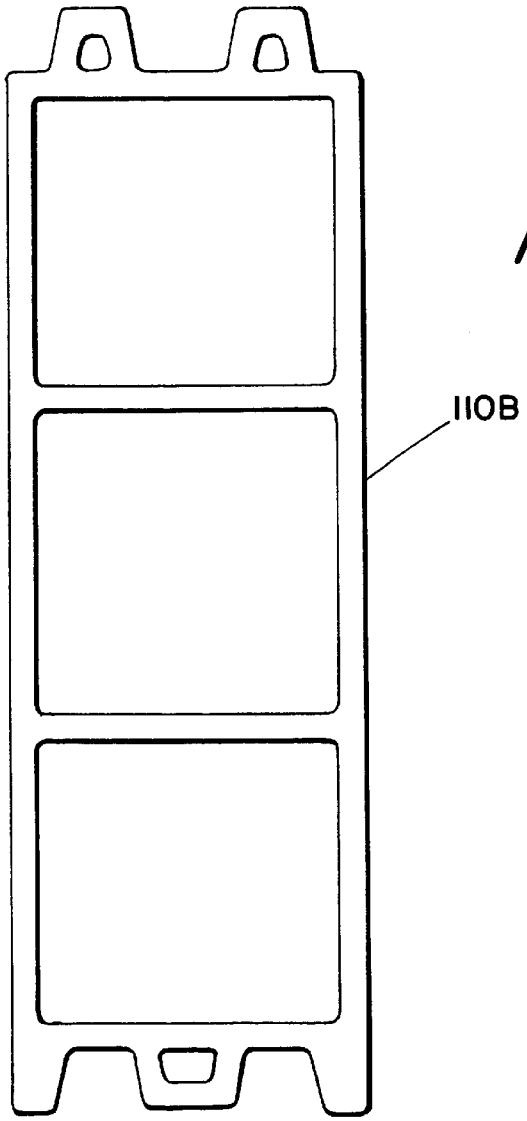
FIG. 20 is a cross sectional view of a preferred embodiment of an interior wall panel of the present invention.

An interior wall section 80 may comprise a plurality of interior wall panels 110 which are extruded components that are connected together in a stack. FIGS. 19 and 20 illustrate various embodiments of interior wall panels 110. FIG. 19 shows an embodiment of an interior wall panel 110A, and FIG. 20 shows an embodiment of an interior wall panel 110B.

As shown in FIG. 19, a plurality of interior wall panels 110 may be horizontally-oriented. However, like the exterior wall panels 30, the interior wall panels 110 may also be vertically oriented. Regardless of the orientation, each interior wall panel 110 may have at least one receptacle and/or at least one protrusion. A protrusion of one interior wall panel 110 is preferably adapted to fit into a receptacle of an adjacent interior wall panel 110. As a result, the interior wall panels 110 may be connected together in a stack by inserting a protrusion of one interior wall panel 110 into a receptacle of an adjacent interior wall panel 110. In addition, it is preferred that an adhesive or other similar means is used to further secure interior wall panels 110 together in a stack.

The interior wall panels 110 may be stacked in the same manner as the exterior wall panels 30. Thus, in a preferred embodiment which includes a plurality of horizontally-oriented interior wall panels 110, each interior wall panel 110 may have a bottom side and a top side. Each bottom side may have at least one receptacle, and each top side may have at least one protrusion which is adapted to fit into the at least one receptacle of an adjacent interior wall panel 110. Consequently, the interior wall panels 110 may be connected together in a stack by inserting the at least one protrusion of one interior wall panel 110 into the at least one receptacle of an adjacent interior wall panel 110. In this type of embodiment, the at least one receptacle may be a channel.

In another preferred embodiment that employs horizontally-oriented interior wall panels 110, each interior wall panel 110 may have a bottom side and a top side. Each top side may have at least one receptacle, and each bottom side may have at least one protrusion which is adapted to fit into the at least one receptacle of an adjacent interior wall panel 110. As a result, the interior wall panels 110 may be connected together in a stack by inserting the at least one protrusion of one interior wall panel 110 into the at least one receptacle of an adjacent interior wall panel 110. The at least one receptacle may be a channel in this type of embodiment.

In a preferred embodiment where the plurality of interior wall panels 110 are vertically-oriented, each interior wall panel 110 may have a left side and a right side. Each left side may have at least one receptacle, and each right side may have at least one protrusion which is adapted to fit into the at least one receptacle of an adjacent interior wall panel 110. Consequently, the interior wall panels 110 may be connected together in a stack by inserting the at least one protrusion of one interior wall panel 110 into the at least one receptacle of an adjacent interior wall panel 110. In this type of embodiment, the at least one receptacle may be a channel.

In another preferred embodiment that includes vertically-oriented interior wall panels 110, each interior wall panel 110 may have a left side and a right side. Each right side may have at least one receptacle, and each left side may have at least one protrusion which is adapted to fit into the at least one receptacle of an adjacent interior wall panel 110. The interior wall panels 110 may then be connected together in a stack by inserting the at least one protrusion of one interior wall panel 110 into the at least one receptacle of an adjacent interior wall panel 110. The at least one receptacle may be a channel in this type of embodiment.

A preferred embodiment of the present invention may interlock adjacent interior wall panels 110 in an interior wall section 80. Adjacent interior wall panels 110 may be interlocked in the same manner that adjacent exterior wall panels 30 may be interlocked. Consequently, adjacent interior wall panels 110 may be interlocked regardless of their orientation.

One interior wall section 80 may be connected to another interior wall section 80. Similar to a fastening panel 40, an interior fastening panel may be adapted to connect an edge of one interior wall section 80 to an edge of another interior wall section 80. For instance, an interior fastening panel may join two interior wall sections 80 together at an angle. The angle may be about 90 degrees. On the other hand, an interior fastening panel may join two of the interior wall sections 80 together such that the two interior wall sections are substantially coplanar. In addition, an interior fastening panel may be interlocked with an interior wall section 80.

An interior fastening panel may be an extruded component. Although not shown, an interior fastening panel may be substantially similar to a fastening panel 40, and it may interconnect wall sections in substantially the same way as a fastening panel 40. In addition, it should be recognized that an interior fastening panel and an interior wall section 80 may be reinforced in substantially the same way as fastening panels 40 and exterior wall sections 20.

In addition, an edge of one interior wall section 80 may be connected to a side of another interior wall section 80. An embodiment of an interior wall connector 90 may be adapted to connect an edge of one interior wall section 80 to a side of another interior wall section 80. Accordingly, this embodiment of an interior wall connector 90 preferably includes a channel which is adapted to receive an edge of an interior wall section 80.

Figure 30:
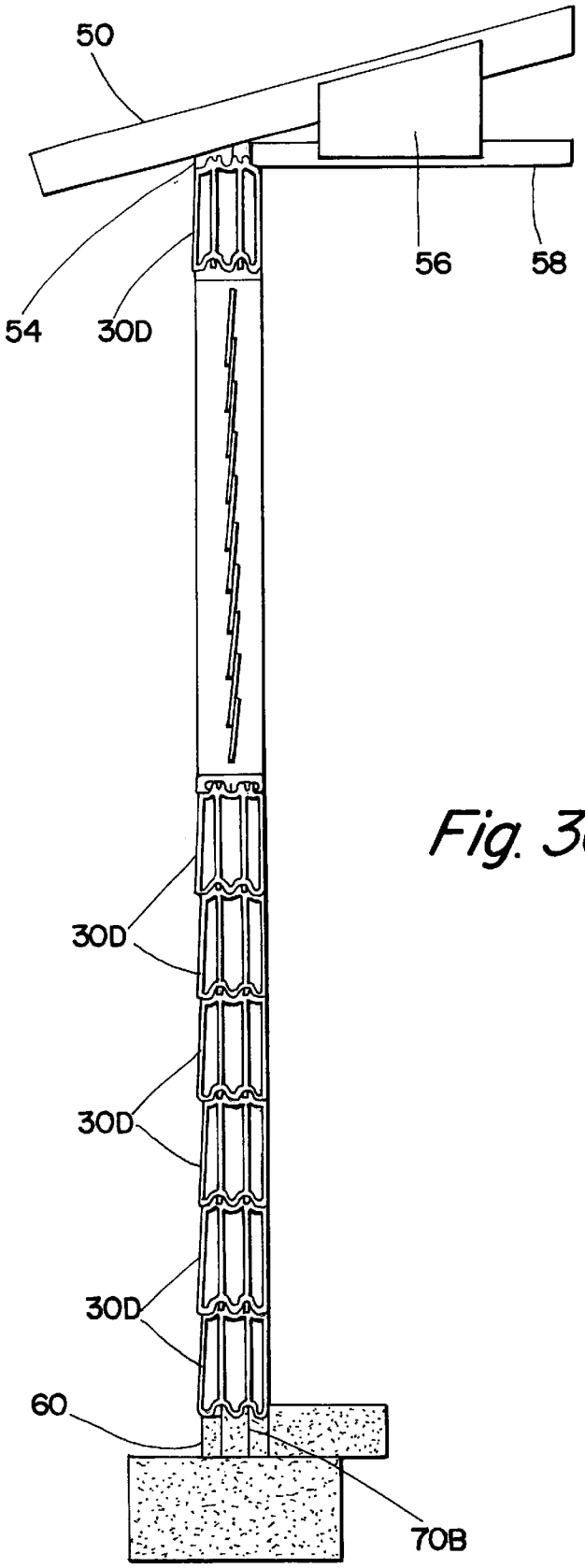
FIG. 30 is a partial cross sectional view of a modular building structure of the present invention.
Figure 31:
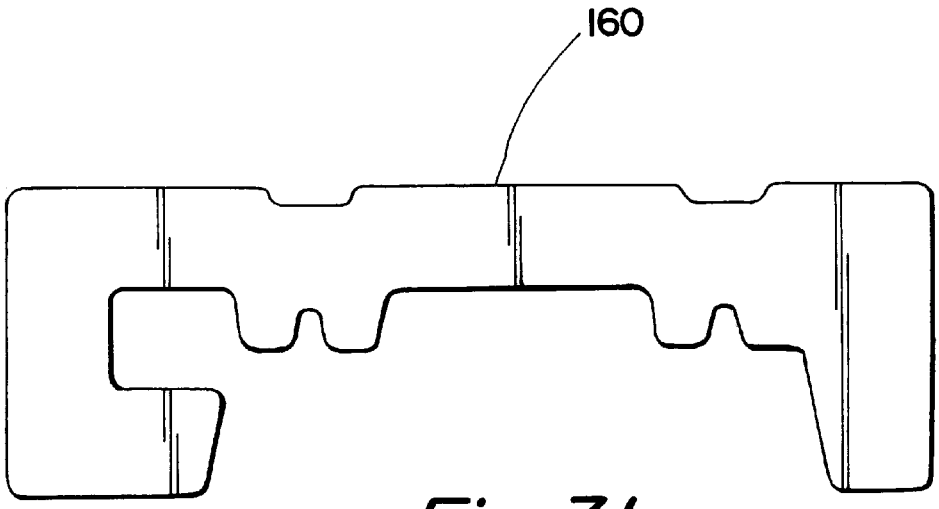
FIG. 31 is a cross sectional view of a window frame of the present invention.
Figure 32:
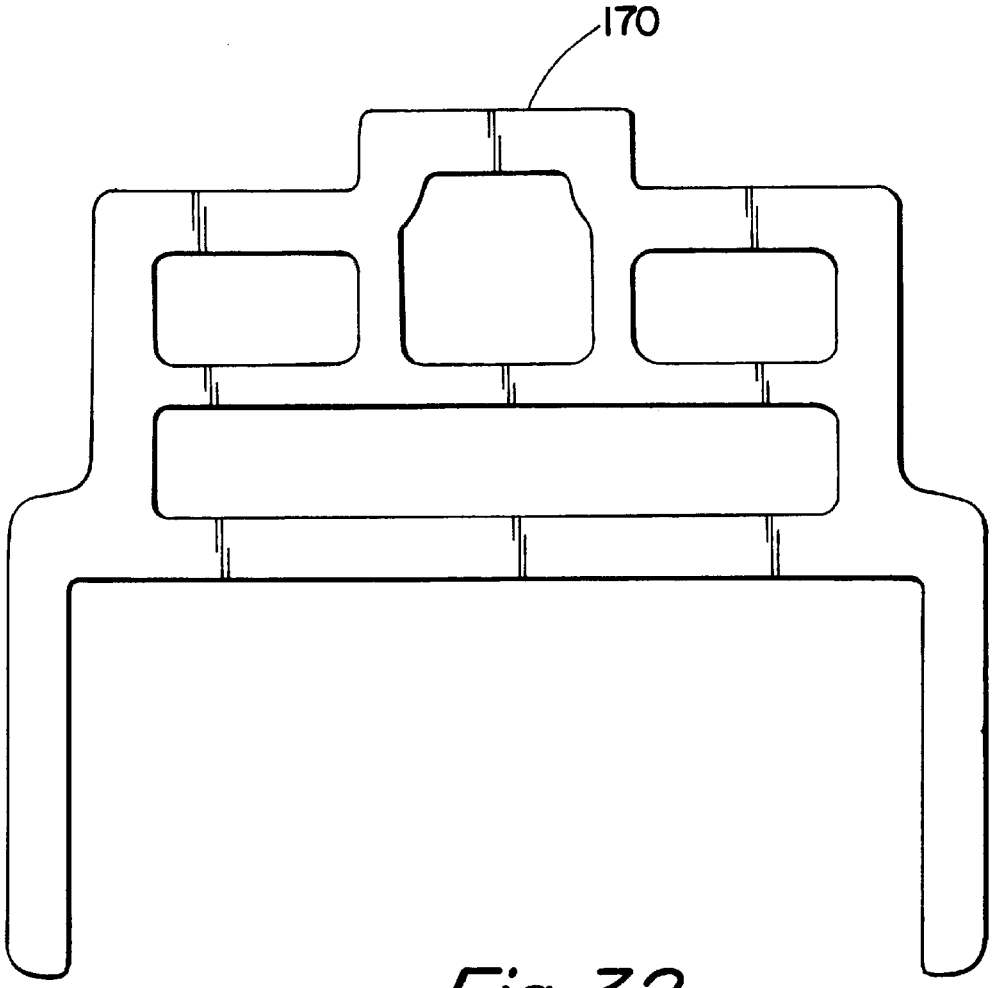
FIG. 32 is a cross sectional view of a jamb of the present invention.

FIG. 30 is a partial cross sectional view of a preferred embodiment of a building structure of the present invention. FIG. 31 is a cross sectional view of a preferred embodiment of a window frame of the present invention. Finally, FIG. 32 is a cross sectional view of a preferred embodiment of a jamb of the present invention.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A modular wall structure comprising:

a plurality of horizontally-oriented wall panels connected together in a substantially vertical stack, each of said wall panels being an extruded, synthetic component having at least one interior hollow, at least one receptacle, at least one protrusion, and at least one outer portion angled relative to vertical to simulate at least one row of horizontally-oriented siding;

a first fastening panel connected to a left edge of said modular wall structure;

a second fastening panel connected to a right edge of said modular wall structure; and a reinforcing member extending through one of said at least one interior hollow in one of said wall panels, said reinforcing member having a left end portion secured to said first fastening panel and a right end portion secured to said second fastening panel;

wherein adjacent wall panels are connected together by inserting said at least one protrusion of a first adjacent wall panel into said at least one receptacle of a second adjacent wall panel.

2. The modular wall structure of claim 1 wherein each of said wall panels comprises:

a top side having said at least one protrusion; and a bottom side connected to said top side, said bottom side having said at least one receptacle.

3. The modular wall structure of claim 1 wherein each of said wall panels comprises:

a top side having said at least one receptacle; and a bottom side connected to said top side, said bottom side having said at least one protrusion.

4. The modular wall structure of claim 1 wherein said at least one receptacle is a channel.

5. The modular wall structure of claim 1 wherein said at least one protrusion of said first adjacent wall panel is adapted to mate with said at least one receptacle of said second adjacent wall panel.

6. The modular wall structure of claim 1 wherein said adjacent wall panels are interlocked.

7. The modular wall structure of claim 1 wherein said reinforcing member is comprised of means for reinforcing said modular wall structure.

8. The modular wall structure of claim 1 wherein said first and second fastening panels are extruded components.

9. The modular wall structure of claim 1 wherein:

at least one of said fastening panels is adapted to connect said modular wall structure to another wall structure.

10. The modular wall structure of claim 1 wherein:

one of said wall panels has a side edge which defines a notch; and one of said fastening panels has a penetrating member connected to a surface that is substantially adjacent to one of said edges of said modular wall structure, said penetrating member extending into said notch such that lateral movement of said one of said wall panels in relation to said one of said fastening panels is limited.

11. The modular wall structure of claim 1 wherein:

a plurality of said wall panels have side edges that define notches; and one of said fastening panels has a penetrating member connected to a surface that is substantially adjacent to one of said edges of said modular wall structure, said penetrating member extending into said notches such that lateral movement of said wall panels in relation to said one of said fastening panels is limited.

12. A building system comprising:

at least one horizontally-oriented wall panel having a generally vertical side edge that defines at least one interior hollow, said wall panel being an extruded, synthetic component having at least one receptacle, at least one protrusion and at least one outer portion angled relative to vertical to simulate at least one row of horizontally-oriented siding;

an expansion block connected to said generally vertical side edge; and a vertically-oriented fastening panel abutted against said expansion block;

wherein said expansion block is adapted to expand and contract to compensate for expansion and contraction of said at least one horizontally-oriented wall panel and said vertically-oriented fastening panel; and a reinforcing member extending through one of said at least one interior hollow in said wall panel, said reinforcing member having an end portion secured to said fastening panel.

13. The building system of claim 12 wherein said expansion block is comprised of elastic material.

14. The building system of claim 13 wherein said expansion block is comprised of a foamed polymer.

* * * * *

UNITED STATES PATENT AND TRADEMARK OFFICE

CERTIFICATE OF CORRECTION

PATENT NO. : 6,295,778 B1
DATED : October 2, 2001
INVENTOR(S) : Burt

It is certified that error appears in the above-identified patent and that said Letters Patent is hereby corrected as shown below:

Column 13,
Line 3, please delete "said adjacent wall panels are interlocked." and replace it with -- each of said wall panels is comprised of thermoplastic material. --

Signed and Sealed this

Twenty-third Day of April, 2002

*Attest:*

*Attesting Officer*

JAMES E. ROGAN
*Director of the United States Patent and Trademark Office*